United States Patent [19]

Hiratake et al.

[11] Patent Number: 4,610,296

[45] Date of Patent: Sep. 9, 1986

[54] MELTING CAST INSTALLATION

[75] Inventors: Susumu Hiratake, Kasugai; Yoichi Nakanishi, Nagoya; Sinobu Inuzuka, Inazawa; Kato Takeo, Nagoya; Hiroyuki Yamada, Kohnan; Yasuo Watanabe, Chita, all of Japan

[73] Assignee: Daidotokushuko Kabushikikaisha, Japan

[21] Appl. No.: 680,869

[22] Filed: Dec. 12, 1984

[30] Foreign Application Priority Data

Dec. 13, 1983 [JP] Japan ..... 58-234807
Jun. 25, 1984 [JP] Japan ..... 59-130245

[51] Int. Cl.[4] ..... B22D 27/02

[52] U.S. Cl. ..... 164/469; 164/495; 164/508; 164/514

[58] Field of Search ..... 164/469, 470, 495, 496, 164/497, 508, 509, 514, 515; 75/10 R, 10 P, 10 V; 373/20, 24, 44, 45, 63, 71, 75, 79, 81

[56] References Cited

U.S. PATENT DOCUMENTS 2,191,478 2/1940 Hopkins ..... 164/515
2,541,764 2/1951 Herres et al. ..... 164/469 X
3,511,303 5/1970 Parsons ..... 164/470
3,894,573 7/1975 Paton et al. ..... 164/469

*Primary Examiner*—Kuang Y. Lin
*Attorney, Agent, or Firm*—William A. Drucker

[57] ABSTRACT

The raw material in a raw material feeding apparatus of a melting cast installation is supplied, through a guide cylinder vertically mounted inside a furnace wall, towards a melting pot of a casting apparatus. A plurality of plasma arc torches, for heating the raw material, are positioned on the upper rotatable half of said furnace wall and are radially arranged around the axis of said guide cylinder with front ends thereof directed individually towards said melting pot. The raw material feeding apparatus may consist of a rotatable cylindrical drum laid substantially horizontally and a helical compartment wall to define a raw material path inside said cylindrical drum. A cylindrical limiter may be vertically mounted, inside said guide cylinder, for vertical movement so as to form an adjustable annular path for raw material between said limiter and the internal surface of said guide cylinder. An ignition piece, common for all the plasma torches, may be provided for retreat from an igniting position into a receptacle.

10 Claims, 57 Drawing Figures

MELTING CAST INSTALLATION

BACKGROUND OF THE INVENTION

1. Field of the Invention

This invention relates to a melting cast installation in which metals of various kinds and in various forms, such as granular sponge titanium, granular hardners or cutting scraps of metals made in various machining processes, are continuously molten as raw materials and then continuously solidified, being reformed into ingots of various metals such as titanium, alloys thereof and so on.

2. Description of the Prior Art

In a melting cast installation according to the prior art, the molten pool of metal, made in a melting furnace by melting raw material, is poured into a melting pot for continuous casting and these operations are repeated every time when the molten pool of metal prepared at one time has completely been processed. It is, therefore, a serious problem that the speckles due to the inhomogeneity in the constitution of produced ingots result in deterioration of products.

The applicants considered a process consisting of sending continuously raw material for melt to a melting furnace, continuously melting the raw material in the melting furnace and obtaining ingots by solidifying molten pools according to the order of their production. As an apparatus for performing such process, they considered a combination of a melting furnace provided with a belt conveyor for sending the raw material to the melting furnace and plasma torches for melting the sent raw material and of a casting apparatus for solidifying molten pools of raw material.

The above described raw material for melt is generally a composition of a great variety of elementary materials. They are of every sort and kind in size, volume and specific gravity such as spongy or lumped. They are also different in forms such as granular or linear.

The above described raw material for melt is itemized into batches of a prescribed amount of raw material, which are transferred one after another to the melting furnace on the belt conveyer. However, a batch of raw material while being transferred on the belt conveyer, is mixed mutually with front and rear adjacent ones due to vibration generated by the belt conveyer and, consequently, changes the composition of elementary materials in respective batches. Furthermore, a locally uneven disposition of the elementary materials takes place, even with respective batches. For example, an elementary raw material of larger specific gravity is collected in a lower layer and that of a smaller specific gravity is disposed in an upper layer. As a result, when such batches of raw material are molten in the melting furnace, the quality of the molten pool of raw material varies successively according to the above described variation of the composition and the organization of an obtained ingot becomes irregular along the growing direction thereof. Furthermore, the molten pool of raw material at each time is different in quality from point to point due to the spatially uneven disposition of the different elementary materials and the organization of the ingot also becomes uneven in the direction of its thickness.

In addition, when the raw material is molten in the melting furnace, regions are produced which become molten more rapidly or more slowly since a very straight plasma arc extends from a plasma torch. Also, due to this situation, the quality of the molten pool varies spatially, resulting in the irregular organization of the ingot.

Applicants also considered utilization of a screw conveyor instead of the above described belt conveyer. However, since the raw material for melt includes a material apt to be caught, such as wires, it maybe tangled between a cylinder and a screw of the screw conveyer, stopping the operation thereof. The melting and casting of the raw material is therefore interrupted during the restoration of the belt conveyer and consequently, there appear irregularities in the organization of the ingot.

SUMMARY OF THE INVENTION

It is therefore an object of the present invention to provide an apparatus in which raw material for melt consisting of a composition of a great variety of elementary materials can successively be transferred to a melting furnace without changing the original composition and in a homogeneously mixed state, and be molten successively there where molten pools of raw material are successively solidified, one after another, according to the order of their production and an ingot of regular organization as a whole can be produced.

When the raw material is supplied to the melting furnace in the above described apparatus in order to produce ingots, the raw material is prepared in the form of many batches of raw material which are itemized by a prescribed amount. Each batch consists of a great variety of elementary materials mixed beforehand at a prescribed composition. Such batches are successively supplied to the furnace.

According to the pesent invention, a drum feeder is employed in order to supply batches of raw material to the melting furnace. A cylindrical drum rotatable in a casing of the drum feeder is interiorly provided with a helical compartment wall. A number of batches of raw material are charged one by one into the entrance end of a helical raw material path defined by the compartment wall every time the path advances axially by one pitch as the drum makes a full rotation. Accordingly, there is always exactly one batch of raw material per one pitch of the path in the drum.

Each batch of raw material advances in the path towards the outlet end of the path as the drum rotates. In this case, adjacent batches of raw material do not mix with each other since they are separated by the compartment wall. Thus, the original composition in each batch is preserved while the batch is transferred from the entrance of the drum feeder to the furnace.

Each batch of raw material advances in the path, repeating upward movement due to the rotation of the drum and the downward collapse due to gravity. In this manner, a great variety of elementary materials, which constitute each batch of raw material, can be transferred in a homogeneously mixed state.

Moreover, in this case, each batch is transferred crumbling downward on the inner surfaces of the drum and the compartment wall surrounding the batch wile they are rotating together. Accordingly, each batch of raw material is not caught between a fixed portion (casing) and a movable portion (drum). Namely, the rotation of the drum is not disturbed by any means. The drum can therefore rotate quite smoothly. As a result, a certain rate of raw material (batches) is sent out toward the melting furnace as time passes.

The rate of raw material supplied to the melting furnace is thus stabilized and hence melting of the raw material is smoothly performed. The obtained molten pool of raw material is also homogeneous throughout its volume since the raw material is homogeneously mixed. Furthermore, since the composition of the raw material supplied successively is kept constant, the quality of the molten pools, which are successively formed as the raw material is molten, is always constant (in the case of an alloy, for example, a molten metal pool, its composition is constant as well). Accordingly, even when molten pools are simply solidified one after another according to the order of their production and ingots are formed, the organization in the ingot becomes constant in the growing direction and the direction of thickness. Namely, homogeneous ingots are obtained. In the case of an alloy, homogeneous and uniform ingots are obtained.

Further, in the melting furnace according to the present invention, the provision of a guide cylinder and a limiter contributes to the formation of the above described homogeneous ingots. The batches of raw material supplied to the melting furnace include a great variety of elementary materials. Among them, there are elementary materials which are easily scattered or difficult to be scattered because of the above described differences in their specific gravities and forms. The raw material from the feeder drops into the guide cylinder provided with a tapered lower end thereof and drops through the guide cylinder toward a crucible. The guide cylinder is furthermore provided near a lower opening thereof with a vertically movable limiter. Accordingly, those elementary materials, difficult to scatter in the raw material, which have descended from the feeder, drop quietly along the guide cylinder from the lower end opening toward the crucible, while the easily scattered elementary materials collide with the guide cylinder and the limiter to lose their kinetic energy and drop quietly from the lower opening of the guide cylinder into the crucible. Accordingly, the batches of raw material sent out from the feeder preserve the aforementioned homogeneously mixed state and all the elementary materials contained in the batches, regardless of the difference in specific gravities and forms, drop toward the central portion of the crucible. The scattering of the raw material in horizontal directions in the crucible is thus limited. Thus, when the raw material in the crucible is molten, the quality of the molten pool of raw material is homogeneous at any point. Consequently, formation of homogeneous ingots can be achieved.

Furthermore, the arrangement and movable construction of plasma torches in the melting furnace according to the present invention contribute to the formation of the above described homogeneous ingots. In the melting furnace, according to the present invention, a plurality of plasma torches are arranged at regular intervals around the guide cylinder. The arrangement is moreover such that any pair of plasma torches are disposed opposite to each other with respect to the axis of the guide cylinder. When a plasma arc is extended toward the raw material in the crucible from each of plasma torches in such arrangement, the plasma arcs extended from a pair of confronting plasma torches have such an influence on each other that they are pulled to each other and hence toward the axis. Accordingly, the mutually affecting plasma arcs can heat and melt the raw material charged onto the central portion of the crucible as in the aforementioned manner from both sides of the raw material. Such operation of the plasma arc is similarly possible with other pairs of plasma torches arranged opposite to each other with respect to the axis of the guide cylinder. The raw material is thus heated and molten by plasma arcs extended in multi directions around the raw material. Furthermore, the plurality of plasma torches are rotated around the axis in order to increase the area of the raw material irradiated by the plasma torches. While being rotated, the plurality of plasma torches preserve the aforementioned mutual relation of arrangement. Accordingly, even while being rotated, the plasma arc extended from any of the many plasma torches does not become unstable. The raw material disposed at the central portion of the crucible can always be heated homogeneously from all around its periphery.

As a result of the foregoing features, the raw material charged into the crucible (raw material consisting of a great variety of homogeneously mixed elementary materials) is rapidly molten homogeneously at a spatially constant rate) as a hole. Consequently, a molten pool of raw material is formed which is homogeneous everywhere in the crucible. As a result, formation of homogeneous ingots is achieved.

According to the present invention of such features, batches of raw material of a constant composition can be supplied from the feeder toward the melting furnace in a homogeneously mixed state, in a certain time and at a constant rate. The raw material can moreover be molten with the homogeneously mixed state maintained in the melting furnace as well and a wholly homogeneous molten pool can be formed. In addition, all the batches of raw material supplied successively from the feeder can similarly be molten. As a result, ingots which are homogeneous in the growing direction as well as in the direction of thickness can be formed by solidifying the molten pools of raw material according to the order of their production.

BRIEF DESCRIPTION OF THE DRAWINGS

The Drawings show the examplary embodiments of the present invention.

DESCRIPTION OF THE PREFERRED EMBODIMENTS

Figure 1:
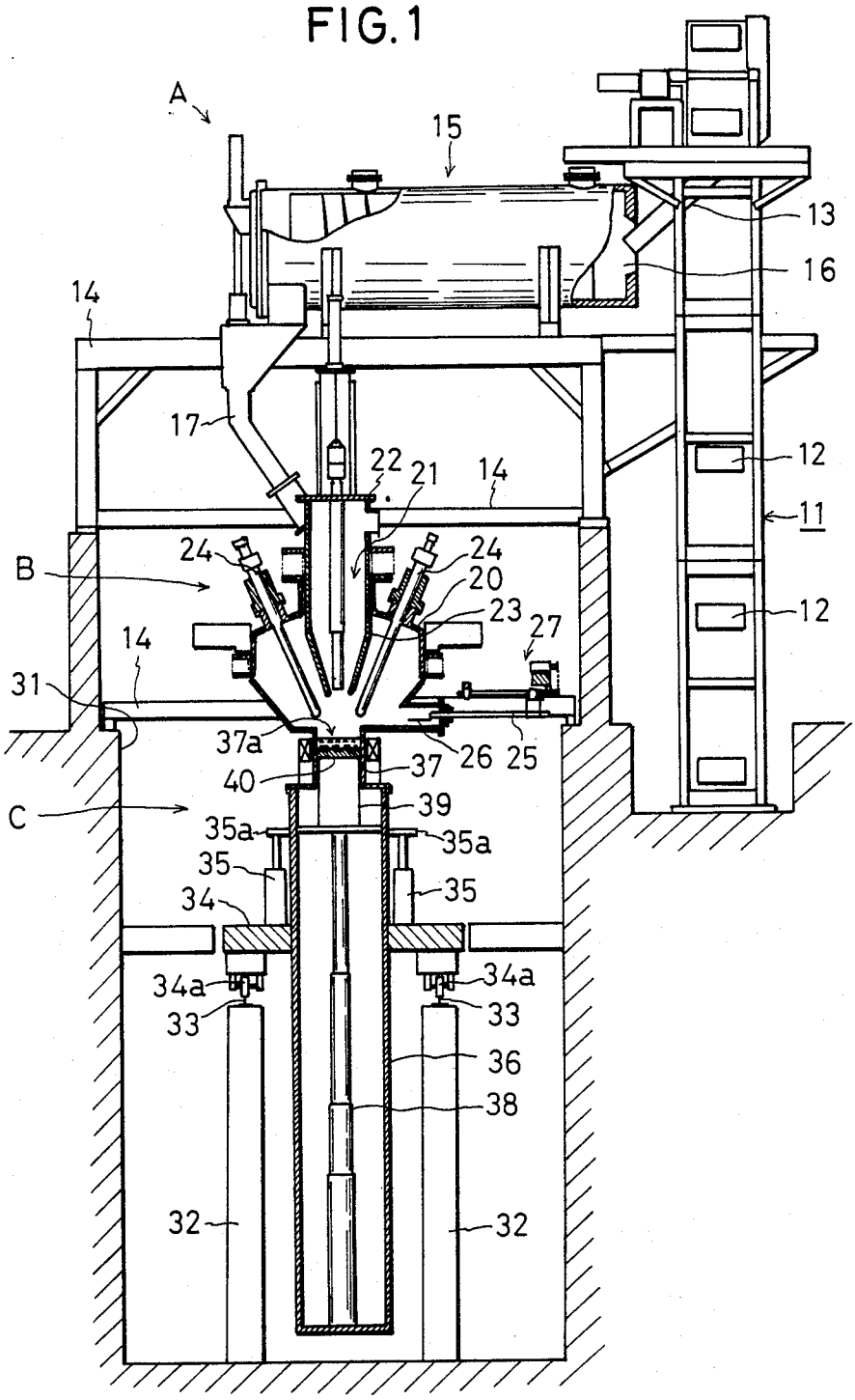
FIG. 1 is a schematic longitudinal section of a melting cast apparatus.
Figure 2A:
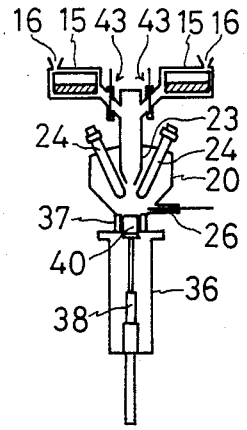
FIG. 2 consists of views for explaining sequentially the operations of the apparatus of FIG. 1.
Figure 2D:
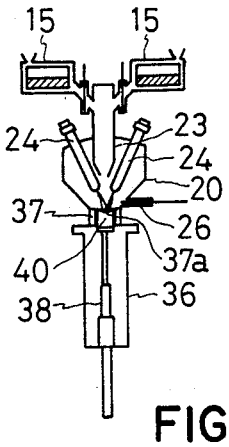
Figure 2G:
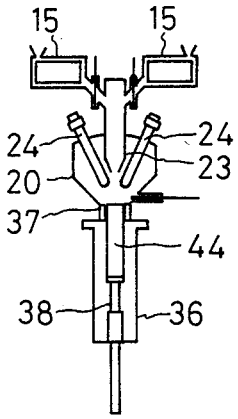
Figure 2B:
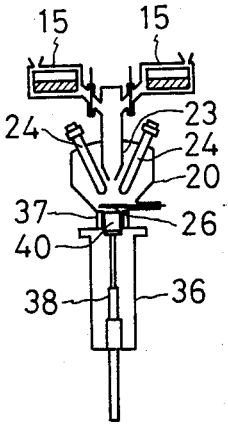
Figure 2E:
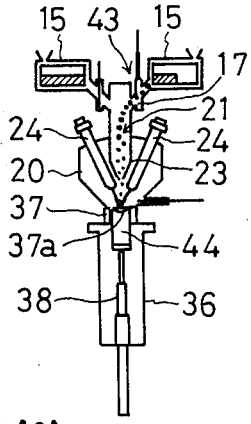
Figure 2H:
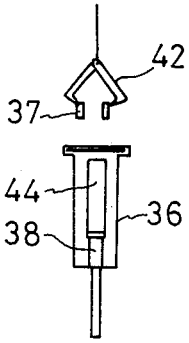
Figure 2C:
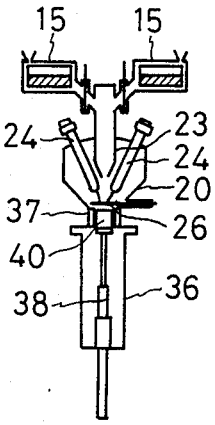
Figure 2F:
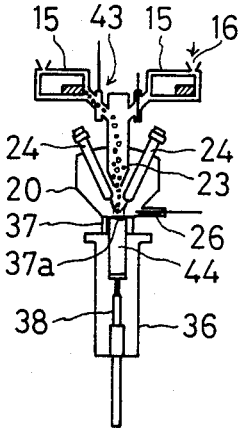
Figure 2I:
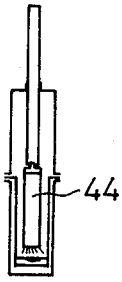
Figure 2J:
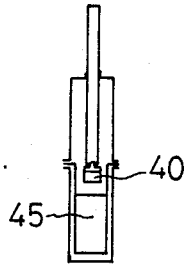

The embodiments of the present invention are now described. The outline of a progressive plasma arc titanium melting furnace (abbreviated hereafter to PPC melting furnace) is first described.

I Plasma arc melting

The plasma arc is an interelectrode arc which is surrounded by a gas flow and is heated up by the compression due to thermal and magnetic pinches. In practice, a plasma arch torch is utilized in which a water-cooled cathode made of tungsten is surrounded by an insulated water-cooled nozzle made of copper and the working gas is passed through the gap between the cathode and the nozzle to be jetted out from the aperture thereof.

On the basis of this principle, the plasma arc torch for melting is adaquately designed by contriving electric power supply, gas feed and water circulation so that a stable and powerful plasma arc may be generated and sustained under some severe circumstances in a furnace. It has the following features:

(a) It produces a ultrahigh temperature of 12,000° C.

(b) It can be transferred towards a body to be heated with high directional stability and is maintained stably against the change of arc length and atmospheric pressure.

(c) It is workable with inert argon gas.

(d) The fine adjustment of output is easy.

(e) A quiet plasma arc can be generated and scattering of the material to be heated or occurence of noise, therefor, scarcely takes place.

(f) Desired high output is obtained by using a large electric current and heat is effectively transferred from the plasma arc.

II Features of PPC melting

PPC melting is a technique developed for melting active metals such as titanium and some alloys thereof and is a continuously melting and casting process in which the raw material charged into a water-cooled melting pot is made molten by a plasma arc and, at the same time, a progressively solidified ingot is obtained by lowering the bottom of the melting pot. The following features of PPC melting are exhibited by the combination of a nonconsumable plasma torch, a water-cooled metal vessel and the atmosphere of argon at atmospheric pressure:

(a) Raw material can be molten without being contaminated.

(b) There is no loss or change of raw material and alloy constituents due to the evaporation thereof.

(c) Raw materials of various forms can be used, as they are, and it is also possible to annex the slag for refining.

(d) Power can freely be adjusted and melting and solidifying conditions can be arbitrarily set.

(e) Homogeneous heating is obtained, the molten pool of metal can be maintained shallow, and satisfactory progressive solidification is possible.

III Various scrap materials such as used wires, pieces of plates and cutting scraps as well as virgin raw materials (sponge titanium, annexed alloys and the like) are molten as raw materials, and the results of the detailed examination into the ingots obtained in this manner and those produced by vacuum arc (VA) remelting are as follows:

(a) Even such raw material as consisting of 100% scraps can satisfactorily be molten by PPC melting.

(b) There is not any increase of impurity.

(c) In PPC melting, melting at a high rate or a low rate can freely be selected and sufficiently dense electrodes for VA melting are obtained.

(d) In PPC melting, magnesium chloride contained in the sponge can be removed and the VA melting is more stable and easy than in usual cases.

(e) The secondary ingots obtained with PPC melting exhibit those external appearance, constituents, purity, degree of segregation and mechanical properties which are equivalent to those of the materials remelted by the VA remelting not less than twice. It is consequently concluded that ingots of excellent quality can economically be produced by the process consisting of the primary PPC melting and the VA remelting.

IV Several points to be considered on the design of the PPC melting furnace are now described.

In designing, the aforementioned features of the PPC melting are, of course, utilized to the maximum extent, but also productivity, safety, operability and maintenance must sufficiently be taken into account. Let the design of the PPC melting furnace have the following features:

(a) Adding, melting and casting of raw material are all carried out in a hermetically sealable construction similar to a vacuum vessel.

(b) The atmosphere in the vessel can be replaced completely with argon gas after evacuation.

(c) Two feeders can smoothly supply virgin raw materials and scraps in succession from the outside thereof.

(d) The passage for raw material is wide and, moreover, the raw material can quietly be added to the central portion of the melting pot.

(e) Plasma arcs rotate automatically over the melting pot and can heat more widely under the effect of a stirring magnetic field coil.

(f) The raising and lowering operation of the torch is not necessary for the start and stop of a plasma arc.

(g) Melting pots are interchangeable and it is possible to change the size of cast ingots.

(h) A multi-cylinder withdrawing apparatus of ingots is adopted and the ingot room can be made smaller.

(i) A fourfold safety means consisting of a relief valve, a breakable port, an automatic isolator of the melting pot and explosion-proof walls is provided against the abnormal rise of pressure in the furnace.

(j) The monitoring of the operations and situations in the furnace is completely remote-controlled and each unit operation is automated.

In the next section, an example of construction, operation and specification is described.

The present furnace consists of a furnace body (a raw material storage tower, a melting chamber, a melting pot and an ingot chamber), a raw material feeding apparatus (a weighing machine, belt and bracket conveyers, a transfer hopper, a drum feeder and a shoot), a vacuum evacuation equipment (an oil rotary pump and a mechanical booster pump), an oil feeding means, a gas feeding equipment (argon and air), a water circulation equipment and an electric equipment (a direct current power supply means for plasma arcs, a power board, a relay board, a plasma controlling board and a furnace operating board). The basic specification of the present furnace is as follows:

(a) uses; production of titanium ingots as consumable electrodes (b) type; PPC—2000 T (c) raw material to be molten; sponge titanium, hardners, titanium waste or waste alloys (maximum 80 mm squares)

(d) size of ingots: 355 mm and 435 mm in diameter and maximum 3000 mm in length (cylindrical form)

(e) weight of ingots; maximum 2000 kg (f) plasma output; 540 W (g) melting atmosphere; argon gas (at atmospheric pressure)

(h) raw material feeder; rotary drums (260 kg/drum × two drums, speed of cutting down of 1 to 8 kg/min.)

(i) degree of attainable vacuum; 1.3 Pa (j) utilities main electric power supply; three phase, 60 Hz, 3300 V and 1220 KVA cooling water; 1.2 $m^3$/min.

compressed air; 5 $m^3$N/charge (maximum 1.5 $m^3$N/min.)

argon gas; 0.3 to 0.7 $m^3$N/min. when melting, maximum 1 $m^3$N/min. × 8 min. when replacing gases Respective parts of the above-mentioned furnace are now explained in proper order.

(A) Raw material feeding

The raw material is first brought to an automatic weighing machine of an accuracy of ±0.05%. The weighing machine weighs 20 kg of titanium and two kinds of hardener materials, which have been moved by an electromagnetic feeder from respective storage hoppers, so that the materials may be blended in a prescribed proportion in a load cell. The raw material, having been weighed, i.e. the mixture of three brands, is cut down on the belt conveyer, and is then transferred over the floor, being led to the bucket conveyer. This conveyer, which is adapted to carry the raw material to the drum feeder held over the furnace, comprises 13 buckets, each receiving 20 kg of raw material. The operation up to this point is called the bucket charge and is automatically carried out. After the operation up to this point, the door on the charge inlet of the drum feeder opens and the transfer hopper is displaced to the inlet, the raw material in the buckets being thus fed into the drum feeder. The drum feeder consists of a hermetically sealable cylindrical vessel, which is 1100 mm in internal diameter and 3800 mm in length, and of a rotary drum nearly inscribed therein. A helical compartment wall is provided on the internal surface of the rotary drum. The compartment wall has 13 pitches over the full axial length thereof. The raw material is automatically charged by 20 kg per pitch by the operation of drum charging. The raw material is therefore charged at 13 portions in all along the whole length of the drum. After the drum charging, the hopper retreats and the door on the charge inlet is closed. The inside of the drum is evacuated to a pressure of 65 Pa and argon gas is then filled therein to atmospheric pressure. As the melting process starts and the phase of raw material feed comes, a seal valve on the discharge outlet of the drum feeder opens. The raw material is mixed and moved towards the discharge outlet by the rotating drum, the cutting down of the raw material thus starting. The cut down raw material is directed towards the raw material storage tower in the melting chamber via the shoot. The raw material is here braked to be slowed down, dropping directly towards the central portion of the melting pot. Since the speed of revolution of the rotary drum is finely adjustable in the range of 0 to 0.4 rpm and the raw material path leading to the melting pot is not less than 140 mm in width, the pieces of raw material in various forms can smoothly be fed at a constant rate. There are prepared two drum feeders. While the raw material is discharged from one of the feeders, it is charged into the other one and the two feeders are exchanged every time when 260 kg of raw material has been cut down. The repetition of this operation, called the raw material feeding, including the gas replacement operation, is automated. The conditions of the raw material charged into each bucket and the drum are graphically displayed in an operating room so that the residual quantity of raw material can be checked at a glance.

(B) Melting cast

The cast shell is 1700 mm in internal diameter and 1200 mm in height. The melting chamber is a water-cooled jacket construction, consisting of a stainless inner wall and a soft iron outer wall, and is separable into top and bottom sections. The raw material storage tower is accommodated in the central opening of the top section and therearound 6 plasma arc torches are symmetrically mounted towards the center of the melting pot. In the bottom section, an ignition bar for starting up the plasma arcs is mounted for insertion to just under the plasma torches. The bottom section is secured on the floor so as to support the whole melting chamber, while the top section is rotatably supported by rollers around the raw material storage tower and can rotate 6 plasma torches by ±60° maximum and at a speed of revolution of 1 rpm maximum. An oil hydraulic cylinder is used for rotating the plasma torches and the joint portions thereof are specially devised so that the rotation may be smooth and good airtight properties may be assured.

The melting pot is a water-cooled jacket construction, consisting of a copper internal wall and a stainless outer one. Inside the melting pot, a solenoid coil is provided, which generates DC and low frequency AC magnetic fields.

The ingot chamber, which is 900 mm in internal diameter and 5500 mm in height, has therein an ingot withdrawing means and is supported by four oil hydraulic jacks on a truck. The melting pot is positioned on the ingot chamber and is closely connected with the melting chamber by raising the jacks and biasing cooperating springs. The ingot withdrawing means consists of multi oil hydraulic cylinders and a stub cramp mounted thereon. Before melting, a stub piece, left over in a prior VA remelting process, is cramped and is put in the melting pot by stretching the multi oil hydraulic cylinder.

In order to start melting, the furnace is first evacuated. An oil rotary pump of 7500 l/min. and a mechanical booster pump of 1500 $m^3$/h are used, a pressure of 6.5 Pa being attained in 13 minutes. Argon gas is then filled therein and maintained at the atmospheric pressure. These processes are automatically carried out as the so-called furnace argon gas replacing operation.

Arrangements for melting are then completed by feeding water and turning on electric power, the plasma arc ignition being thus made ready. By the so-called torch igniting operation, insertion of the ignition bar, ignition of a pilot arc, generation of main plasma arcs and retreat of the ignition bar are wholly automatically carried out and the plasma arcs are directed towards the inside of the melting pot to initiate melting of the stub on the top surface thereof. The melting process can fully be watched on two colour I T V s in the operation room. The electric power for 6 torches is fed by an exclusive DC power source, which comprises a high voltage incoming panel, a phase compensation capacitor panel, a high voltage transformer and six thyristor panels with turn-on circuits therefor. This power source is excellent in mild start up of plasma arcs and constancy of load current and can feed either six individual circuits or three sets of two-parallel ones as well so that the electric currents through a plurality of torches can be widely adjusted with a single setting board.

As the melting on the top surface of the stub proceeds and a molten metal bath is formed, the raw material is added into the center of the metal bath by the aforementioned raw material feeding operation and, in succession, the multi cylinder begins to descend at a low speed as a consequence of the ingot withdrawing operation. During this process, the bottom portion of the molten metal bath is cooled in the melting pot and an ingot, which has progressively been grown into a solidified mass, is withdrawn out into the ingot chamber. During this time, the plasma arcs are themselves rotated together with the automatically revolving torches, with their directions controlled by the magnetic field coils, and irradiate the whole melting pot to rapidly melt the annexed raw material. The molten metal bath is also subjected to the stirring force due to magnetic field, heating prevailing uniformly.

The withdrawn amount of the ingot is displayed on an operation panel as the output signal of a stroke meter set in the ingot chamber. The melting speed is determined by the adjustment of the speed of revolution of the drum feeder and, in accordance with this melting speed, the speed of withdrawal of the ingot is determined. Once the speed of withdrawal is set, the operating personnel scarcely need operate. It is also almost unnecessary to manipulate the plasma arc torches except for the initial electric power adjustment for controlling the molten metal bath. For this reason, the present furnace can be operated even by a single person.

In the production of titanium ingots used as consumable electrodes, the raw material can be fed at such a high rate that an ingot having a specific gravity of 90% of the intrinsic specific gravity can be obtained. In the production of an ingot 435 mm in diameter, the raw material can be made molten at a high rate not less than 300 kg/h and the electric power per unit weight of raw material is not more than 1800 kwh/t.

During the melting process, the atmosphere in the furnace is always monitored by a dew point meter. When the pressure in the furnace rises abnormally from some causes, the relief valve opens. When the pressure rises further, the melting pot is automatically disconnected from the melting chamber and the explosion-proof port mounted on the melting chamber breaks to relieve the pressure in the furnace. Since the operator need not go into the inside of the explosion-proof walls, he is not exposed to dangers.

(C) Withdrawal of ingots

When a prescribed quantity of the raw material has been molten, the cooling process results automatically as a consequence of the arc stopping operation and the ingot is cooled in the still maintained atmosphere of argon gas, which is thereafter replaced with air. After the cooling process, the melting pot and the ingot are both placed on the truck by operating the lift jacks, transferred horizontally by the oil hydraulic drive and brought to the ingot outlet position. The melting pot is removed by a crane, the stub cramp is released and the ingot is hung out by the crane. The ingot, just taken out, is placed upside down with its stub portion cramped in the VA remelting furnace and is remelted as a consumable electrode.

(D) Time cycle of melting

An example of a series of work times in PPC melting is as follows:

Withdrawal of the ingot and preparation for melting; 72 minutes
Charge of raw material into buckets; 12 minutes
Charge of raw material into the drum; 10 minutes
Replacement of the atmosphere inside the furnace body with argon gas; 14 minutes
Melting and casting; 300 to 400 minutes
Cooling and replacement of the atmosphere with air; 265 minutes Namely one cycle of the melting process amounts to 11 to 13 hours and it is possible to produce 75 tons a month by the work of three shifts. It is, of course, possible to utilize the present furnace for other active metals such as niobium and zirconium and the furnace is also effective as a primary melting furnace for various functional materials such as hydrogen absorption alloys, shape memory alloys, superconducting alloys and so on.

In the next section, the aforementioned melting and casting installation is explained in reference with the appended drawings. Said installation comprises a raw material feeding apparatus A, a plasma arc melting apparatus B and a casting apparatus C as shown in FIG. 1. To begin with, in the raw material feeding apparatus A, a bucket conveyer 11 is provided with thirteen buckets 12 and receives the raw material, which has been weighed by a weighing machine, not shown, in the buckets and then carries it to a hopper 13 positioned upwards. The weighing machine consists of those combinations of a storage hopper and an electromagnetic feeder that are prepared for each kind and each grain size of raw material. Titanium and two kinds of hardeners, for example, are withdrawn by respective electromagnetic feeders from respective storage hoppers and they are weighed, at one time, by a small unit of total 20 kg so that they may be blended in a prescribed proportion in respective load cells. The weighed raw material, i.e. the mixture of three material, is cut down on one part of the belt conveyer, transferred over the floor and is led to one of many buckets 12 on said bucket conveyer 11. After the first 20 kg of raw material has been contained in one of the buckets, the next 20 kg of raw material is again weighed to be led to another bucket next to the first one. This operation is hereafter repeated until thirteen buckets contain respectively 20 kg of raw material. In the present disclosure, the system consisting of the aforementioned weighing machine, the belt conveyer and the bucket conveyer 11 is referred to as a weighing cut down means. On a frame 14 erected next to said bucket conveyer is provided a drum feeder 15 used as the raw material feeding apparatus. This is one of two drum feeders arranged parallel. (The other is hidden behind that shown in FIG. 1). A charge inlet 16 is formed through one end wall of each of said drum feeders and is adapted to receive the raw material emerging from the hopper 13. The hopper 13 is situated over the bucket conveyer and adapted to catch the whole quantity of raw material dropping from the bucket, which is then turned upside down when the bucket conveyer is shifted by one bucket pitch. The charge inlet is closed by a door while the raw material is not charged therethrough. A shoot 17 is connected to the other end of the drum feeder 15.

Next in the plasma arc melting apparatus B, a melting chamber 20 is fixed beneath the frame 14 under said drum feeder. This melting chamber 20 is internally made sealable and has a charge inlet 21 for raw material at the top central portion thereof. The top of the charge inlet 21 is closed by a hermetically sealing portion 22 so that the hermetic seal in the melting chamber 20 may be maintained. Said shoot 17 also communicates with the hermetical sealing portion 22. On the other hand, a guide cylinder 23 formed integrally with the hermetical sealing portion 22 hangs down under the charge inlet 21 and the raw material charged towards the charge inlet 21 is guided by said guide cylinder so that the raw material can drop into the central portion of a melting pot, which is to be mentioned later. In said melting chamber, six plasma arc torches 24 are arranged around the charge inlet 21. These plasma arc torches are radially positioned at regular intervals of 60° and the cathode of each plasma arc torch is connected to the respective minus terminal of the exclusive power source. Through the bottom portion of the melting chamber 20, a support rod 25 is provided for movement to the left and the right in FIG. 1. An ignition piece 26 is attached to the front end of the support rod 25. The rear end of the support rod 25 is connected to a reciprocation means 27 so that the support rod 25 can move in the aforementioned direction.

The casting apparatus C is now explained. This casting apparatus C is accomodated inside a pit 31. On the floor of the pit 31, a pair of upright support legs 32 are provided, on the tops of which a pair of rails 33 are laid lengthwise along the direction perpendicular to the page of FIG. 1. A truck 34, provided with wheels **34*a*, is adapted to slide on the rails 33. Oil hydraulic jacks 35 are set up on the truck 34 and an ingot chamber 36 is placed on the brackets 35*a* attached on the tops of the piston rods of the jacks. A melting pot 37 is formed on the ingot chamber 36 and engages an opening formed in the bottom of said melting chamber 20. As is usually known, a molten pool of metal is formed in the melting pot. Inside the ingot chamber 36, an ingot withdrawing means 38 is provided. This withdrawing means 38 consists substantially of a multi cylinder. The top end of the withdrawing means 38 is provided with a stub cramp 39, to which a stub 40** forming the bottom wall of the melting pot is annexed. The stub cramp is provided with power feed terminals for connection to the plus terminals of the aforementioned DC power source for respective plasma arc torches.

The operation of the above mentioned construction is now described in regular sequence in reference to FIG. 2. In FIG. 2, two drum feeders 15 are shown abreast for the purpose of obtaining good understanding. As shown in FIG. 2A, the raw material is charged into the drum feeder 15 with a seal valve 43 on discharge outlet of the drum feeder 15 closed and the atmosphere therein is simultaneously replaced with argon gas. With the seal valve still closed, the ingot chamber 36 inside the melting chamber 20 is evacuated and argon gas is then introduced therein to the atmospheric pressure. As shown in FIG. 2B, the ignition piece 26 is transferred under the plasma torches 24. As shown in FIG. 2C, a pilot plasma arc is initiated between the ignition piece 26 and each plasma arc torch 24. As shown in FIG. 2D, the ignition piece 26 is transversely withdrawn from under the plasma arc torches and a main plasma arc is subsequently formed, which is directed from each plasma torch 24 towards the stube 40. In this situation, the top end of the stub is made molten by the plasma arcs and there is formed a molten pool of metal **37*a*. As shown in FIG. 2E, the seal valve 43 of one of the drum feeders 15 is opened and the raw material is sent into the charge inlet 21 in the melting chamber 20 through the shoot 17**. The raw material, being guided by the guide cylinder 23, drops towards the central portion of the molten pool of metal 37*a*. The raw material, having dropped, is made molten by the plasma arcs emerging from the plasma arc torches. While the raw material is sequentially molten in the above-mentioned manner, the stub 40 is gradually lowered by operating the withdrawing means 38. The speed of descent of the means 38 is adjusted to be such that the top surface of the molten pool of metal 37*a* is always maintained at a constant height, i.e. a speed which is adequately adjusted in accordance with the quantity of the raw material charged into the melting pot per unit time. In the course of continuing the above-mentioned operation, the molten material, i.e. the molten raw material charged previously, is cooled by the water-cooled walls of the melting pot 37, being reformed into an ingot 44 integral with the stub 40. The ingot 44 is gradually withdrawn in the downward direction as the stub 40 descends and grows gradually longer as shown in FIG. 2E. If all the raw material in one of the drum feeders 15 has been discharged out into the melting chamber in the course of continuing the aforementioned operation, the seal valve 43 of the first mentioned drum feeder 15 is closed and the seal valve 43 of the other drum feeder 15 is simultaneously opened (in this case, the atmosphere of the drum feeder 15, with the seal valve 43 thereof opened, is beforehand replaced with argon gas), and the raw material is fed towards the melting chamber 20 from the other drum feeder in the same manner as mentioned above. The emptied drum feeder 15 is again filled with the raw material carried by the bucket conveyer 11. When an ingot 44 of a prescribed size as shown in FIG. 2G has been formed by repeating the above-mentioned operation, the feed of raw material to the melting chamber is stopped and the plasma arcs are extinguished. Said ingot 44 is then cooled in the still maintained atmosphere of argon. After the ingot 44 has been cooled down to such a temperature that the ingot 44 is not oxidized in the atmosphere of air, the atmosphere in the ingot chamber 36 is displaced with air. The ingot chamber 36 and the melting pot 37 are thereafter disconnected from the melting chamber 20 as shown in FIG. 2H and are transferred by the truck 34 to the ingot take out position. The melting pot 37 is removed by a crane 42 as shown in FIG. 2H, the stub cramp is released and the ingot 44 is hung out by the crane. The taken out ingot 44 is charged upside down into a well-known remelting furnace, remelted as a consumable electrode and reformed into a remelted ingot 45 as shown in FIG. 2J. In this case, the primary ingot 44 is almost remelted except for a small piece to be reused as the stub 40. The small piece, left unmelted, is reloaded on the ingot withdrawing means 38 and is used for the casting process same as described above.

Figure 3:
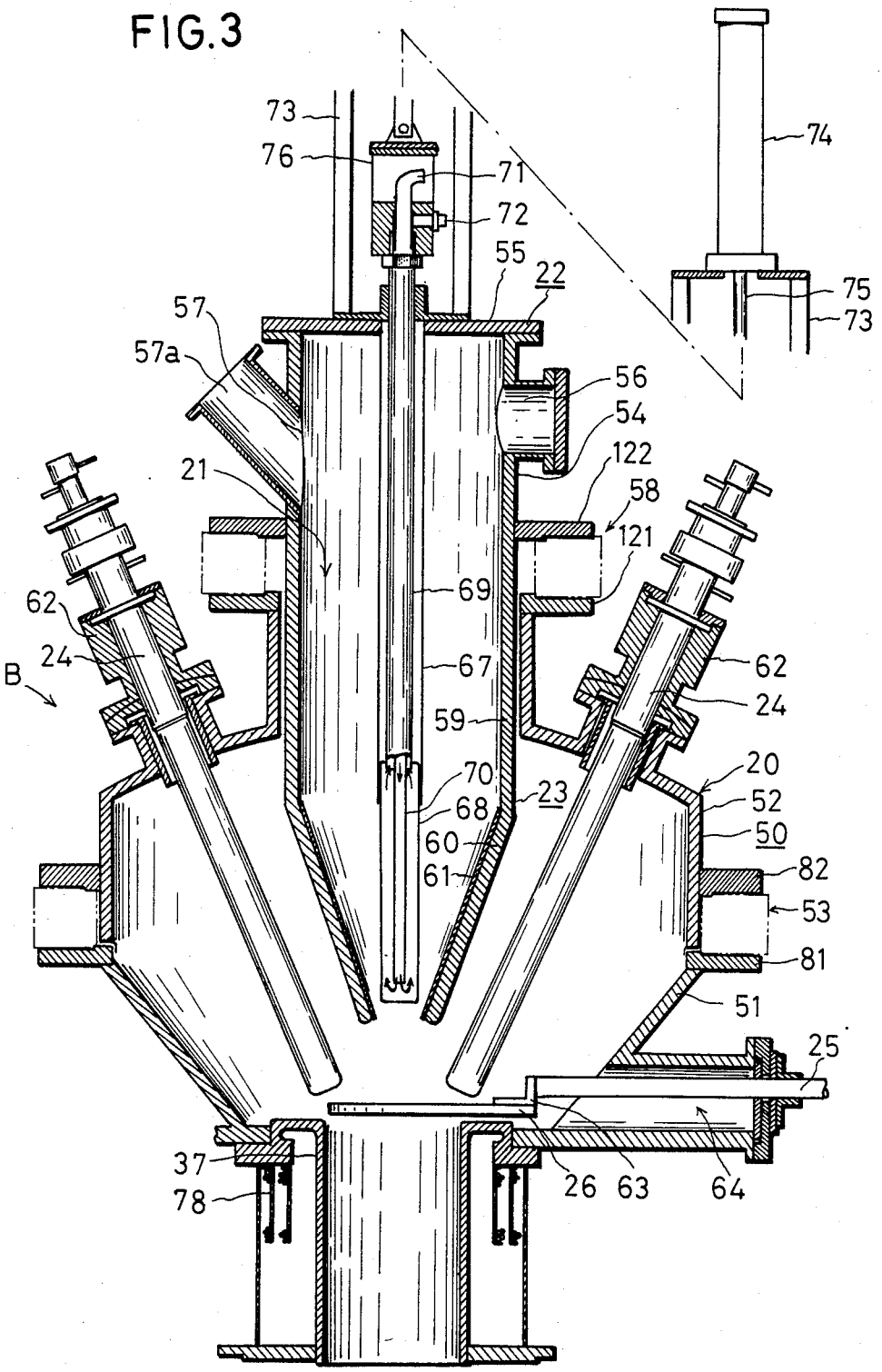
FIG. 3 is a longitudinal section of the melting cast apparatus.

The plasma arc melting apparatus B is next explained in reference to FIG. 3 showing the apparatus in details. The melting chamber 20 is defined by a furnace wall 50 which is so formed as to enclose the space over the molten pool of metal 37*a* inside the melting pot 37. The furnace wall 50 consists of an upper furnace wall 52 and a lower furnace wall 51, which are both water-cooled as is well known. A connecting member 53 is provided between the lower furnace wall 51 and the upper furnace wall 52 and the upper furnace wall 52 is rotatably positioned against the lower furnace wall. A seal means is moreover interposed between the lower furnace wall 51 and the upper furnace wall 52 so that any gas can not circulate between the inside and the outside of the furnace wall 50. The aforementioned hermetical sealing portion 22 includes a cylindrical portion 54 and a plate member 55 closing the upper opening of the cylindrical member 54. An inspection port 56 and a feed port 57 for raw material are bored through the side wall of the cylindrical portion 54. The feed port 57 is provided with a pipe 57*a* adapted to communicate with said shoot 17. A connecting member 58 is used between the bottom of the cylindrical portion 54 and the top of the aforementioned upper furnace wall 52, which is rotatably positioned against the cylindrical portion 54. There is provided also a sealing member the same as previously described. The aforementioned guide cylinder 23 is also referred to as a raw material storage tower and consists of an upper guiding right cylinder 59 and a lower guiding tapered cylinder 60 joined therewith. The internal surface of the lower guiding cylinder 60 is provided with a lining made of titanium. The hermetical sealing portion 22 and the guide cylinder 23 are made integral with each other as aforementioned and these are of water-cooled construction as is well known. A guide pipe 67 with the top end portion thereof fixed in the plate 55 is vertically accommodated inside the guide portion along the axis of the cylindrical portion 54 and the guide cylinder 59. This guide pipe is exteriorly covered with a titanium layer. Even if some part of the surface of the guide pipe 67 is shaved off by raw material pieces, which are introduced through the feed port 57 and collide energetically on the guide pipe 67, and it is molten in the melting pot 37 together with the raw material, the purity of the ingot produced in the aforementioned manner, therefor, is not lowered. A cylindrical limiter 68 made of titanium is placed under the lower end of the guide pipe 67. This limiter 68 is joined to the lower end of a rise and fall pipe 69 adapted for vertical movement in the guide pipe 67. An inner pipe 70 is inserted through both the limiter 68 and the rise and fall pipe 69 and they form a double pipe construction. A water inlet 71 and a water outlet 72 are provided at the top of the rise and fall pipe 69. The coolant water introduced through the water inlet 71 flows in the inner pipe 70, the limiter 68 and the rise and fall pipe 69 along the path as shown by the arrows, cools them and is exhausted through the water outlet 72. On the plate 55 is erected a support frame 73, on the top of which a cylinder 74 for the rise and fall pipe 69 is mounted. The piston rod 75 is connected to the rise and fall pipe 69 via a connecting means 76 and can be driven by the cylinder 74 to move the limiter 68 up and down. In the present disclosure, the combination of said cylinder 74 and said rise and fall pipe 69 and so on is referred to as the rise and fall means for the limiter 68.

The aforementioned plasma torch 24 is electrically insulated from and positioned against the upper furnace wall 52 with use of a well-known torch mounting construction 62. On the other hand, in the lower space inside the melting chamber 20, said ignition piece 26 is mounted on a bracket 63 attached on the front end of the support rod, and the combination of the above three is referred to as the ignition bar. This ignition piece 26 is adapted to be retreated by the rod 25 into a receptacle 64 formed as a part of the lower furnace wall 51 as the support rod 25 moves to the right of FIG. 3. A magnetic field coil 78 is arranged, in a well-known manner, around the melting pot 37 in order to deflect the plasma arc emerging from the plasma torch 24.

Figure 4:
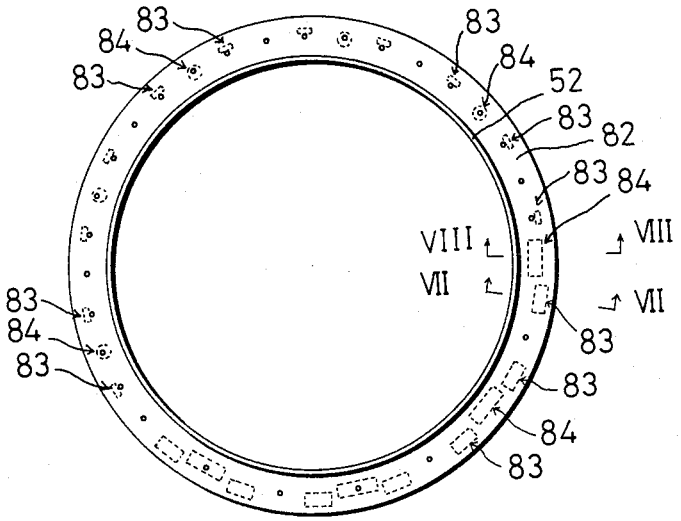
FIG. 4 is a plan view illustrating a connection member between a lower furnace wall and an upper furnace wall.
Figure 5:
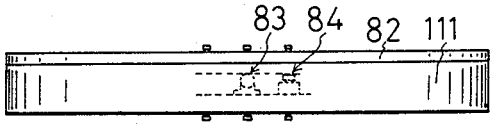
FIG. 5 is a front elevation of the member of FIG. 4.

The construction of the connecting portion between the lower furnace wall 51 and the upper furnace wall 52 is now described in reference to FIGS. 4, 5, 7 and 8. In said connecting portion, the connecting member 53 comprises a flange fixed on the lower furnace wall 51 and another flange 82 fixed on the upper cast wall. The base portion 98 of an annular hold member 97 is secured with bolts 96 on the flange 81. The hold member 97 has a cylindrical holding wall 99 and O-rings 100 and 100 are retained in two endless grooves formed at the outside of the holding wall 99. Between the O-rings 100 and 100 a grease feed groove 101 is formed on the whole circumference of the holding wall 99. A grease inlet duct 102 is vertically formed through the inner portion of the holding wall 99 and communicates with the grease feed grooves 101. The grease inlet duct 102 also communicates with a grease inlet and a grease outlet in a well-known manner and is always capable of supplying grease to the grease feed grooves 101. A number of support means 83 for bearing the weight of the upper furnace wall 52 are mounted on the upper surface of the base portion 98 of the hold member 97 as shown in FIG. 4. This support means consists of a bearing 103 mounted on the upper surface of said base portion 98 and a support roller 104 mounted rotatably in said bearing 103. On the flange 82, the base portion 107 of an annular seal member 106 is secured with bolts 105. The seal member 106 has a cylindrical sealing wall 108 whose inner surface is in contact with said O-rings 100. On account of this contact between the sealing wall 108 and O-rings 100, the atmosphere inside the melting chamber is prevented from leaking out of the melting chamber and any external air is prevented from entering the melting chamber. This construction for dividing the melting chamber is also referred to as the separating means in the present disclosure. This separating means may be any other one of arbitrary well-known constructions. The sealing wall 108 and the O-rings 100 in contact therewith are supplied with grease via the grease feed groove 101 so that the life time of the O-rings may be prolonged. An annular abutment plate 109 is secured beneath the lower surface of the base portion 107 of the seal member 106 and is rested on said support roller 104. A heat shielding wall 110 is formed, as a part of the upper furnace wall 52, inside the holding wall 99 so that the O-rings 100 may be protected against the thermal damage by the holding wall which is heated to a high temperature owing to the thermal radiation from the plasma arc in the melting chamber. Deviation stoppers 84 are provided on the upper surface of the base portion 98 in the hold member 97 in order to prevent the off-center deviation of the upper furnace wall 52. This deviation stopper 84 includes a support block 114 and a deviation stop roller 115. The support block 114 is mounted on the upper surface of the base portion 98 for movement in the left and right direction of FIG. 8 (in the radial direction of the furnace wall 50) and the deviation stop roller 115 is rotatably mounted on the support block 114. A thrust screw 117 is threadedly inserted in an upright piece formed integrally with the outer circumference of said base portion 98 and said support block 114 can be shifted in the aforementioned direction by turning the thrust screw 117, urging the roller 115 closely on the sealing wall 108. The excessive turning of the thrust screw 117 is checked by a lock nut 118. Since the upper furnace wall 52 is supported by the support means 83 against the lower furnace wall 51 and is prevented for deviating by the deviation stopper 84 in the above-mentioned manner, the upper furnace wall 52 can smoothly be rotated by a slight torque. A cylindrical dust-tight cover 111 fixed to the flange 81 is placed outside the support means 83 and the upper flange portion of the dust-tight cover 111 is forced into an annular gap 112 so that any dust can not get in towards said separating means, the support means 83 and the deviation stopper 84. As a consequence of this, the upper furnace wall 52 can be rotated smoothly against the lower furnace wall 51 at all times.

Figure 9:
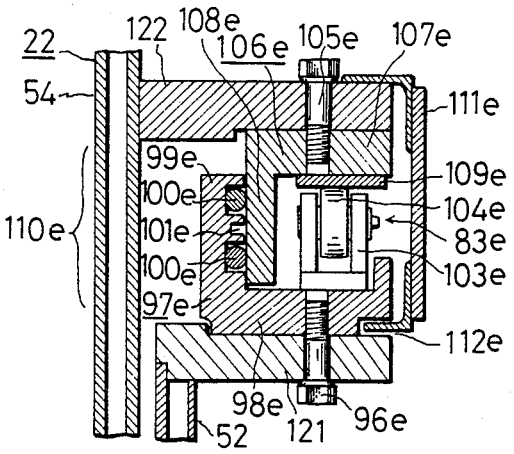
FIGS. 9 and 10 are views similar to FIGS. 7 and 8 respectively but illustrating the connecting member between the upper furnace wall and a hermetically sealing portion.
Figure 8:
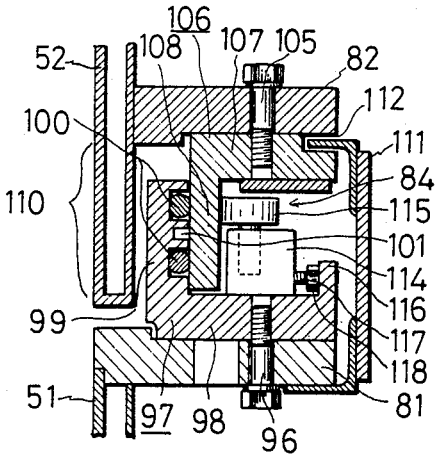
FIG. 8 is a section taken along the line VIII—VIII of FIG. 4.
Figure 10:
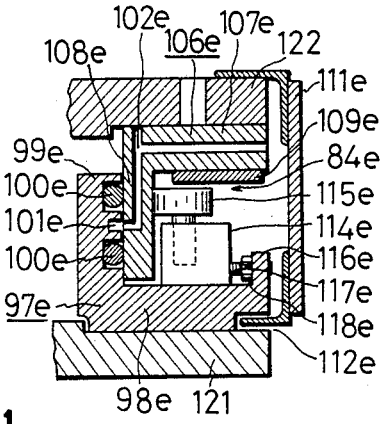

The connecting portion between the upper furnace wall 52 and the hermetical sealing portion 22 is now explained in reference to FIGS. 9 and 10. The connecting member 58 comprises a flange 121 secured on the upper furnace wall 52 and another flange 122 secured on the hermetically sealing portion 22. Between both flanges 121 and 122, a separating means and a plurality of support means and deviation stoppers are provided. Since most of these constructions are similar to those in the aforementioned connecting portion between the upper furnace wall 52 and the lower furnace wall 51, those components in these constructions, which are considered to be functionally equivalent to ones in the previous case, are represented by the numerals same as in the previous case but with an alphabetical suffix e and the same explanation is not repeated.

Figure 6:
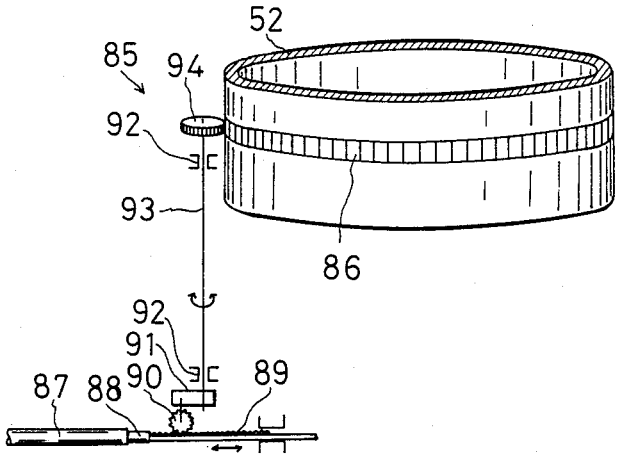
FIG. 6 is a view illustrating the rotating apparatus for the upper furnace wall.
Figure 7:
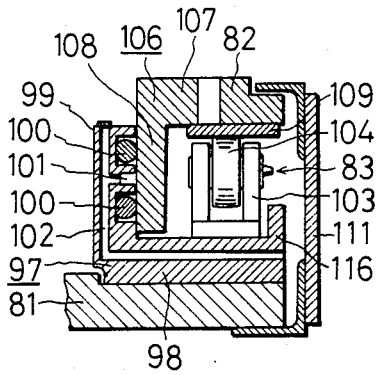
FIG. 7 is a section taken along the line VII—VII of FIG. 4.

A rotating apparatus 85 engaging the upper furnace wall 52 is not shown in FIG. 6. The outer side surface of the upper furnace wall 52 is formed with a gear 86. An oil hydraulic cylinder 87 is mounted on a frame not shown and the piston rod 88 thereof is provided with a rack 89. A drive shaft 93 supported vertically in bearings 92 and 92 is cooperated with a pinion 90, which is in engagement with the rack 89 via an interconnection mechanism 91. A drive gear 94 is mounted on the top of the drive shaft 93 and is in engagement with said gears 86. In the rotating apparatus 85 constructed in this manner, the pinion 90 is rotated in one or the other direction as the piston rod 88 of the cylinder 87 is stretched or contracted. The movement of the pinion 90 is transmitted by the interconnection mechanism 91 and the drive shaft 93 to the drive gear 94 to rotate the same. The upper furnace wall 52 is subsequently rotated forward in one direction shown by the arrow and back in the opposite direction. The angle of rotation is adjusted to be in the range from 60° in one direction to 60° in the opposite direction from the neutral position of the back and forth rotation. The speed of revolution is set to be such that the upper furnace wall rotates, for example, by an angle of 120° in 0.3 to 3 minutes. Since the upper furnace wall 52 is constructed as mentioned above for back and forth rotation, heating prevails uniformly all over the molten pool of metal 37*a* in the melting pot 37 and the raw material charged therein can promptly be melted out.

Figure 11:
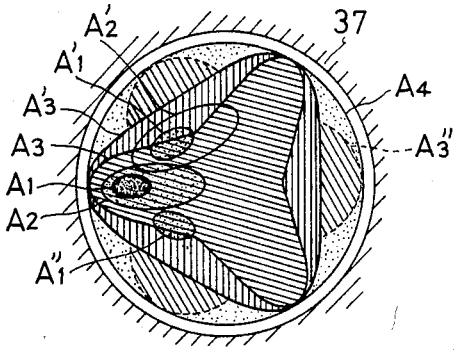
FIG. 11 is a plan view for explaining the melting area in a melting pot.

That is, if the arc spot of the plasma arc emerging from a single plasma arc torch is concentrated in an area shown by $A_1$ in FIG. 11, in the area therearound shown by $A_2$ the raw material is rapidly melted owing to the effective transmission of heat. In the lapse of time, the heat of the arc spot $A_1$ diverges further to the peripheral area of the pool. An area shown by $A_3$ is thus molten due to the heat from the first said plasma arc and in addition from other two plasma arcs produced by other two plasma arc torches which are arranged apart from the plasma arc torch producing said first plasma arc by an angle of 120°. The plasma arc concentrated on said arc spot shown by $A_1$ is deflected by the magnetic flux produced by the aforementioned magnetic field coil 78 and is now concentrated at a new arc spot shown by $A_1'$. Also in the area $A_2'$ around the area $A_1'$, the raw material is rapidly melted and further in the lapse of time, the melting area is extended. On reversing the direction of the magnetic field, the plasma arc is deflected similarly but symmetrically with respect to the area $A_1$ and is concentrated on a new arc spot as shown by $A_1''$. The plasma arcs produced by the other two plasma arc torches are simultaneously deflected by the magnetic field and a similar extension of the melting area results. As a result of these effects, the raw material disposed in an area shown by $A_3'$ is melted in a comparatively short time by the plasma arcs emerging from the three plasma arc torches. Still more three plasma arc torches other than said three are in operation and the raw material in the still broader area shown by $A_3''$ can rapidly be made molten. Moreover, since the upper furnace wall 52 rotates back and forth as mentioned above, said areas $A_3'$ and $A_3''$ turn to the right and the left as viewed in FIG. 11. The raw material in the area, which is shown by $A_4$ and is extending all over the melting pot 37, is rapidly molten. Each part of the raw material charged into the melting pot 37, therefore, can be melted rapidly and uniformly. The angular interval of the back and forth rotation of said plasma torch is preferably determined so that the area in the melting pot radiated by a plasma arc emerging from a plasma arc torch partly overlaps the areas radiated by the plasma arcs emerging from adjacent plasma arc torches.

Figure 12:
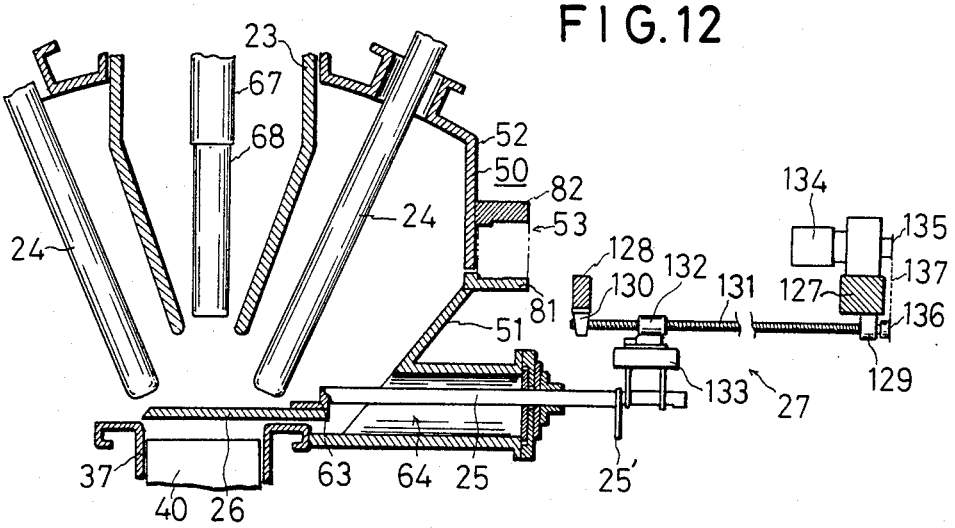
FIG. 12 is a longitudinal section illustrating the relationship between an ignition piece and a reciprocation means thereof in the melting cast apparatus.

The reciprocation means for the ignition piece 26 is now explained reference to FIG. 12. Fixed frames 127 and 128 are provided with bearings 129 and 130 respectively, in which a threaded rod 131 is rotatably supported. With the threaded rod 131 is threadedly engaged a nut 132 which is connected to the support rod 25 via a connection element 133. A power feed terminal 25' to feed the ignition piece 26 is attached on the support rod 25 and is connected to the plus terminal of the DC power source for respective plasma arc torches, being kept at the same potential as the aforementioned stub 40. On the frame 127 is fixedly mounted a motor 134 with a speed reducer thereof and a sprocket 135 mounted on the output shaft of said motor interconnected by a chain 137 to another sprocket 136 mounted on the threaded rod 131.

In the reciprocation means thus constructed, when the motor 134 operates to rotate the sprocket 135, the rotation thereof is transmitted to the sprocket 136 by the chain 137 and, in turn, the threaded rod is rotated. As the threaded rod 131 is rotated, the nut 132 is displaced to the right or the left as viewed in FIG. 12 and the movement thereof is transmitted to the support rod 25 by the connection element 133. The ignition piece 26 advances consequently from the receptacle 64 to the position as shown in FIG. 12, i.e. to an ignition position between the tip of the plasma arc torch 24 and the stub 40 in the melting pot 37 or retreats in the opposite direction from said shown position to the receptacle 64.

Figure 15:
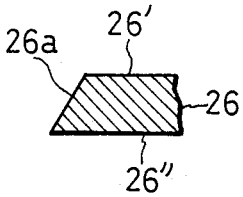
FIG. 15 is a section taken along the line XV—XV of FIG. 14.

In FIGS. 13 to 17 are illustrated some shapes of the ignition piece 26 and the ignition state of the plasma arc torch initiated by the ignition piece 26. The ignition piece 26 is made of graphite and, as shown in the figures, it is of such a size that it can be interposed between the tip of each plasma arc torch 24 and the space inside the melting pot (the space occupied by the stub 40). A peripheral side **26*a*, which becomes the rear side of the ignition piece 26 when it is retreating from the advance ignitiion position as shown in FIG. 12 to the withdrawn position in the receptacle 64, is an upward obliquely tilted surface, as is best seen in the section of FIG. 15. The lower surface of the ignition piece 26, i.e. the surface 26'' placed against the molten pool of metal is, therefore, made broader than the upper surface, i.e. the surface 26'** placed against the plasma arc torch.

Figure 13:
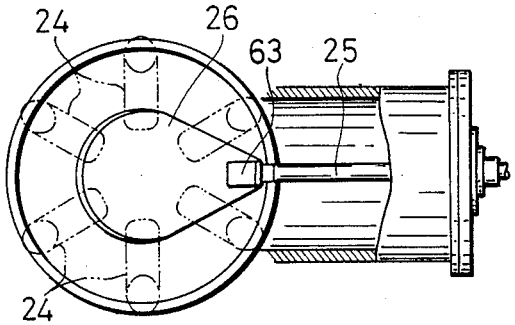
FIG. 13 is a plan view illustrating the relationship between a plasma arc torch and the ignition piece.
Figure 14:
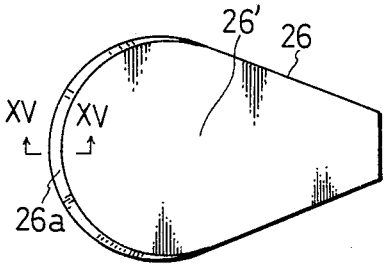
FIG. 14 is a plan view of the ignition piece.

The igniting operation for the plasma arc torch 24 is now explained. The reciprocation means 27 is first operated to bring the ignition piece 26 to the position as shown in FIGS. 12 and 13. In this case, the spacing between the tip of each of all the plasma arc torches 24 and the ignition piece 26 is made smaller than the spacing between the torch and the stub, and is beforehand adjusted to be such that the pilot arc emerging from the torch 24 can reach the ignition piece, i.e. to the ignition length (for example, about 40 mm). The upper furnace wall is turned to such a position where a plurality of plasma arc torches 24 are symmetrically positioned to the left and the right with respect to the reciprocation direction of the ignition piece 26. Each plasma arc torch is supplied with that gas for producing plasma, which jets out of the nozzle and the voltage for sustaining the plasma arc is simultaneously applied between the cathode of each plasma arc torch 24, i.e. a body to be melted (the stub) in the melting pot and the ignition piece 26. In this situation, a well-known high frequency discharge is initiated between the cathode and the nozzle in the plasma arc torch and a pilot plasma arc is formed. A main plasma arc 140 than grows from the cathode of the torch to the ignition piece 26 in a well-known manner. At this time, the current in the main plasma arc 140 is limited to the minimum value necessary for maintaining the plasma arc. The growth of the main plasma arc from the plasma arc torch 24 to the ignition piece 26 takes place simultaneously in all the six plasma arc torches 24 in this case, but it may occur successively in different phases in other cases. When the main plasma arc between the plasma arc torch and the ignition piece 26 has been completed, the reciprocation means 27 is actuated to retreat the ignition piece from between the torch 24 and the stub 40 towards the receptacle 64. The ignition piece is retreated at a speed of about 500 mm/min. While the ignition piece 26 is thus retreated from between each plasma arc torch 24 and the stub 40, the main plasma arc, which has been extending from the torch 24 to the ignition piece 26, is now forced to turn towards the stub 40. When the main plasma arcs emerging from all the torches are entirely transferred to the stub 40, the melting of the raw material on the stub 40 is started by increasing the currents in the main plasma arcs.

Figure 16:
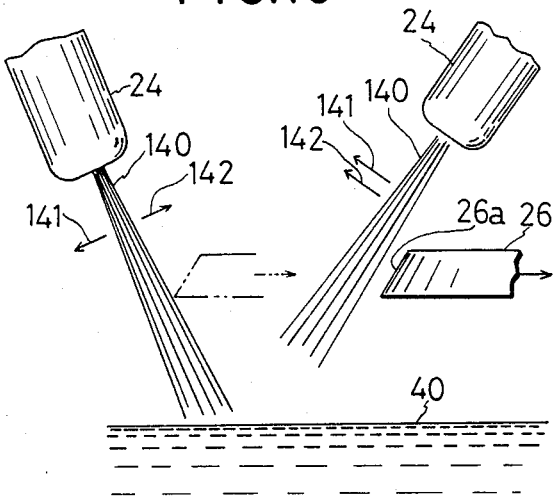
FIGS. 16 and 17 are views for explaining the transfer of the plasma arc from the ignition piece to the raw material on a stub.
Figure 17:
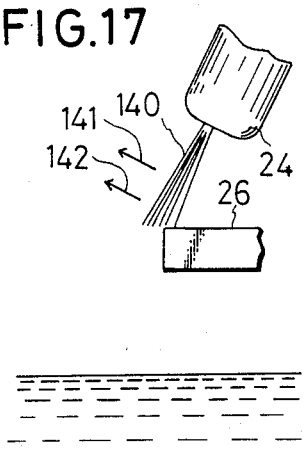

When the plasma arc torch 24 is ignited by the ignition piece 26 in the above-mentioned manner, the plasma arc 140 emerging from each plasma arc torch 24 is subject to a force directed away from the ignition piece 26 in the direction shown by an arrow 141 of FIG. 16, as a consequence of the magnetic interaction of the currents in the plasma arc 140 and in the ignition piece 26. In addition, the plasma arc 140 emerging from each plasma arc torch 24 is also subject to an attractive electromagnetic force pulling the plasma arcs closer to one another, i.e. a force directed in the direction as shown by an arrow 142 in FIG. 16. While the ignition piece 26 is receding in the aforementioned manner, the plasma arc 140 emerging from the plasma arc torch positioned oppositely to the receding ignition piece 26 (to the left as viewed in FIG. 16), with respect to the center axis of the melting pot 27, is exerted on by said two forces, which are substantially cancelling each other. If the repulsive force exceeds possibly the attractive force, the plasma arc 140 is bent, by the predominant repulsive force 141 due to the current flowing from the plasma arc 140 to the ignition piece 26, towards the side such that the length of the plasma arc from the torch to the stub is decreased. The current path to the stub 40 is thus easily established and the plasma arc can stably be transferred from the ignition piece to the stub 40. On the other hand, the plasma arc 140, emerging from the plasma torch 24 positioned to the side of the receding ignition piece 26 (to the right hand side as viewed in FIG. 16), is exerted on by said repulsive force 141 and said attractive force 142, both being directed in the same direction. The plasma arc is consequently bent by said forces towards the side such that the length of the plasma arc from the torch to the stub 40 is elongated and it seems that the current path to the stub 40 is difficult to be established. When the plasma arc 140 is being switched over to the stub 40 from the ignition piece, the plasma arc may not reach the stub 40 but be repelled up by the rear end portion of the ignition piece 26. In this manner, the plasma arc may lose the current path thereof and will be extingushed unless otherwise affected. Since the rear end portion of the receding ignition piece 26 is formed as said tilted surface 26, the plasma arc, struck between the plasma torch 24 and the ignition piece 26, can be in contact with the bottom portion, i.e. the portion nearest to the stub 40, even on departure of the receding ignition piece from the plasma arc. Furthermore, the plasma gas mixture, which is ejected by the plasma arc torch as the basic medium of the plasma arc, can smoothly be directed towards the stub 40 and the plasma arc is scarcely disturbed even at the instant the ignition piece 26 departs the plasma arc. The plasma gas mixture reaches swiftly the raw material on the stub 40 and a part of the plasma arc 140 simultaneously touches the stub 40, the current path thus being established. Since the current carried by the ignition piece decreases and the force 141 is attenuated, the plasma arc can always be maintained with stbility and transferred smoothly. If the rear surface of the receding ignition piece is a vertical surface as shown in FIG. 17, the plasma arc 140 is difficult to transfer to the stub 40 on account of said forces 141 and 142 acting on the plasma arc, on retreat of the ignition piece from between the plasma arc torch and the ignition piece, and the electric and magnetic fields are greatly disturbed. As a consequence of this, not only the plasma arc 140 emerging from the torch thereof but also those other plasma arcs, which have already reached the stub 40, would be extinguished under the influence of the disturbed electric and magnetic fields. Since said rear surface 26*a* of the ignition piece 26 in said apparatus according to the present invention is really made tilted in the aforementioned manner, the plasma arc can be transferred from the ignition piece to the stub 40 with stability.

With use of the ignition piece as described above, the following effects are further obtained. That is, when the plasma arc emerging from each plasma torch is suddenly extingushed and need be restruck, all the plasma arcs from respective torches can be restruck to be almost simultaneously directed to the melting pot and the raw material on the stub in the melting pot can effectively melt without inhomogeneity. In order to more fully interpret this effect, a case is considered in which a great mass of raw material has accidentally dropped into the melting pot or the hermetic seal of the furnace breaks partially to admit air to rush into the furnace in the process of melting a batch of raw material. In this case, some of the plasma arc torches are extinguished and must be reignited. According to the prior art, each plasma arc torch is adapted for independent vertical movement. After having deliberately extinguished the rest of such plasma arc torches with some necessary handlings, each plasma arc torch is one after another drawn near to the melting pot to be reignited. There is, however, a drawback that the prior method for reigniting plasma arc torches requires an elaborate means for displacing vertically said plasma arc torches. It is also an objectionable point that the raw material in the melting pot is inhomogneously melted since the plasma arcs emerge at time intervals from the respectively restruck plasma arc torches. To the contrary all the plasma arc torches of the present installation, first extinguished, are simultaneously reignited by positioning said ignition piece between the plasma arc torches and the melting pot and by then retreating the ignition piece. The restruck plasma arcs, therefore, can simultaneously be directed towards the melting pot. The means for reigniting the plasma arc torches is constructionally simple since it suffices for the reignition to displace the ignition piece.

Figure 18:
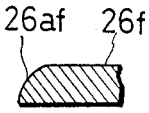
FIG. 18 is a view illustrating a different example of the cross-sectional form of the rear end portion of the ignition piece.

A different example of the rear end form of the ignition piece, when receding, is now shown in FIG. 18. The rear end surface of the ignition piece is not necessarily the tilted plane surface as aforementioned but may be tilted convex surface such as shown in FIG. 18. In this figure, the members considered to be the same as or constructionally equivalent to those in the foregoing figures, are given the same numerals as in the foregoing figures but with an alphabetical suffix f and the same explanation is not repeated. (Also in FIGS. 19 to 21, an alphabetical suffix g is annexed to the numerals according to the same idea and the same explanation is omitted.)

Figure 20:
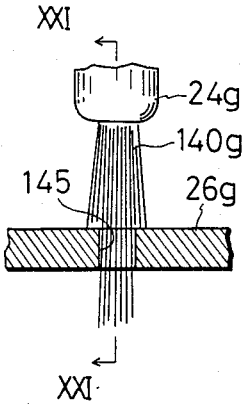
FIG. 20 is a section illustrating the relationship between a groove in the ignition piece and the plasma arc.
Figure 19:
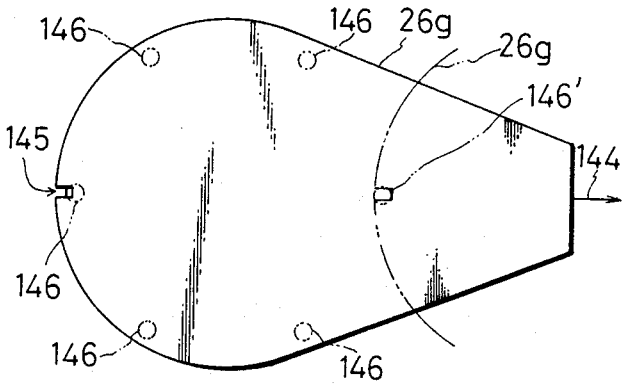
FIG. 19 is a plan view illustrating a different example of the ignition piece.
Figure 21:
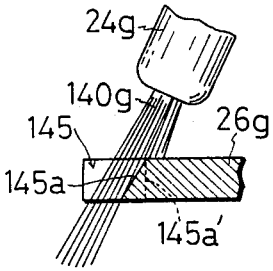
FIG. 21 is a section taken along the line XXI—XXI of FIG. 20.

A still different example of the form of the ignition piece is now shown in FIGS. 19 to 21. The rear end portion of the receding ignition piece 26*g* of these figures is formed with a thin groove 145 such as shown. The width of the groove 145 is adjusted to be such that the intermediate portion of the plasma arc, extending from the plasma arc torch towards the stub 40, can pass through the groove 145 to reach the stub 40 as shown in FIG. 20 (for example about 10 mm). The bottom surface 145*a* of the groove 145 is made a tilted plane surface as shown in FIG. 21 and similarly to the foregoing case. (This bottom surface may alternately be a vertical surface such as shown by the numeral 145*a*'.)

When the plasma arc torch is turned on with the ignition piece 26*g* thus constructed, the upper furnace wall is turned to the position such that the plasma arc emerging from the plasma torch can irradiate the area shown by the numeral 146 on the ignition pieces. With this arrangement, the ignition is carried out in the aforementioned manner.

The ignition piece is thereafter retreated in the direction shown by the numeral 144. When the ignition piece 26*g* moves to the position shown by the conceptional curve and the groove 145 of the receding ignition piece comes to the position shown by the numeral 146, the intermediate portion of the plasma arc 140*g*, directed towards said groove 145, is passed through said groove and is led towards the melting pot as shown in FIGS. 20 and 21. On further receding of the ignition piece 26*g*, said plasma arc itself is thus transfrred with stability from the ignition piece to the stud in the melting pot. In this case, the presence of both side surfaces 145*b* and 145*b* give an equivalent effect as if the rear end portion of the receding ignition piece 26*g* had the obliquely upwardly tilted surface and therefor as if the lower surface of the ignition piece facing the molten pool of metal were broader than the upper surface facing the plasma arc torch, and the arc can thus be transferred with much stability.

Figure 22:
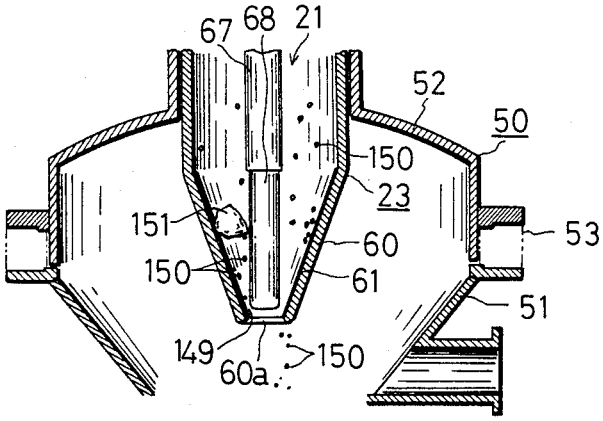
FIG. 22 is a longitudinal section for explaining the movement of the raw material in a guide cylinder.
Figure 23:
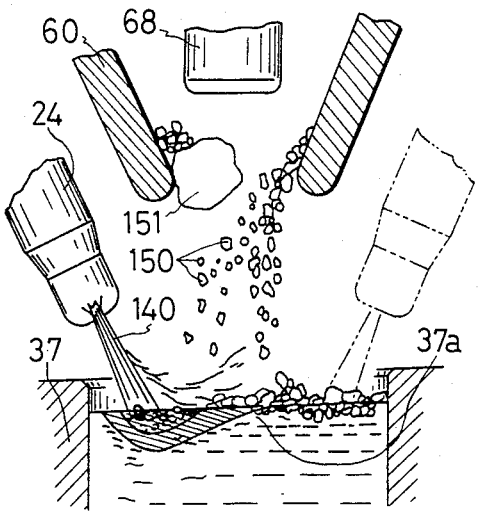
FIG. 23 is a longitudinal section illustrating the relationships between the guide cylinder and the raw material to be charged therefrom and between the melting pot and the plasma arc torch.
Figure 28:
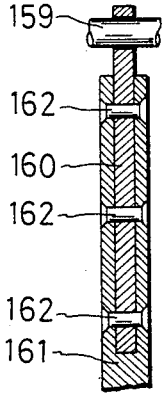
FIG. 28 is a section taken along the line XXVIII—XXVIII of FIG. 27.
Figure 27:
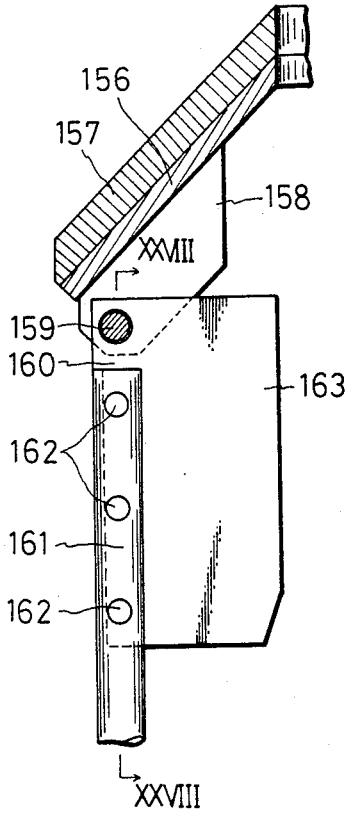
FIG. 27 is a view illustrating more fully the relationship between the cushion member and a base portion therefor.

In FIGS. 22 and 23 are shown the situations in which the raw material is charged into the melting chamber 20 and is melted by the plasma arc emerging from the plasma arc torch. In the following, the operation in these situations is explained. The limiter 68 is usually lowered by the cylinder 74 for the rise and fall pipe and the lowermost end of the limiter 68 is brought in the lower opening 60*a* of the lower tapered guide cylinder 60. In this case, between the internal surface of the opening 60*a* and the limiter 68 is formed an annular gap 149, through which small grains or sponge pieces of titanium (of a size, for example, of 3 to 20 mm) can pass. In this situation, the raw material 150 in the form of small grains or sponge pieces of titanium, which has been sent towards the charge inlet 21 from said drum feeder via the shoot 17 and the feed port 57, is guided towards the central portion of the melting chamber (i.e. of the melting pot) by the upper guide cylinder 59 and the lower tapered cylinder 60 and is then charged towards the central area of the molten pool of metal 37*a* through said gap 149. The large size titanium raw material 151 such as scraps charged in the charge inlet 21 can not pass through the gap 149 but is caught between the lower tapered cylinder 60 and the limiter 68, to be stopped therebetween. After the large size raw material 151 has been stopped at such place, the small size raw material 150 is still continuously dropped towards the molten pool of metal 37*a* for a while and the large size raw material 151 is then dropped towards the molten pool of metal in the melting pot by lifting up the limiter 68 to the positon as shown in FIG. 23. In this case, the central area of the molten pool of metal 37*a* in the melting pot 37, where said large size raw material is to be secondly charged, has been filled with the small size raw material 150 charged beforehand. As a consequence of this, the small size raw material, charged beforehand and piled on the central area of the molten pool of metal, can function as a kind of cushion and absorbs the shock caused by the dropping large size raw material. Even when the large size raw material is charged, the molten pool of metal is prevented from being scattered owing to the effect to suppress the speed of said dropping raw material by the limiter 68 and to the cushioning effect of the small size raw material.

The width of the annular gap 149 can variously be adjusted by selecting the height of the limiter 68. By this adjustment, the size of the raw material, which is temporarily stopped in said guide cylinder 60, can variously be changed. Since the large size raw material is temporarily stopped, rather closely to the melting pot, by the limiter positioned in the melting chamber 20 and is then correctly dropped towards the center of the melting pot, the wall thereof is not damaged by the large size raw material which would otherwise fall outside the melting pot. When the small size raw material 150 is charged in advance and the large size raw material 151 is secondly dropped thereon, the large size raw material is prevented from dropping directly from the charge inlet 21 so that the molten pool of metal does not overflow the melting pot and the plasma arc torch 24 is not injured by the scattered molten metal.

Figure 24:
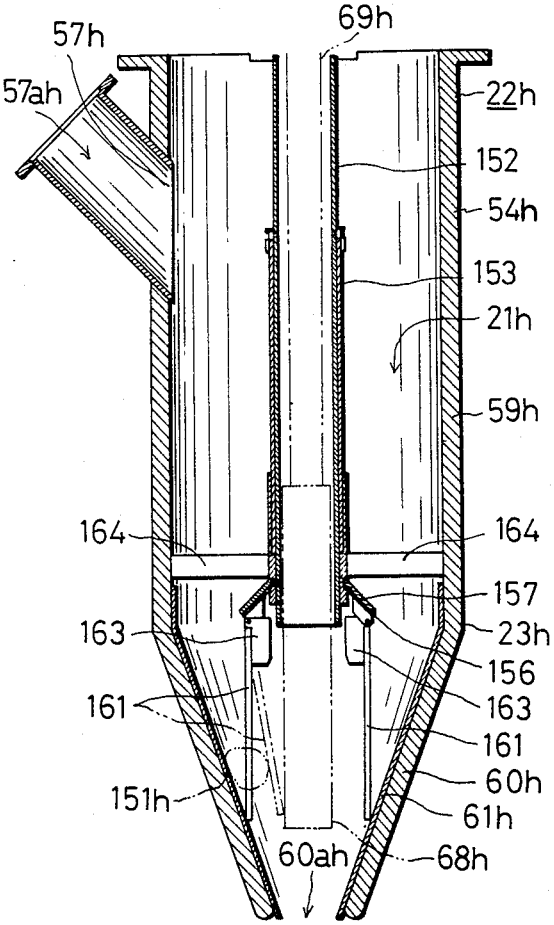
FIG. 24 is a longitudinal section of a different example of the guide cylinder.
Figure 25:
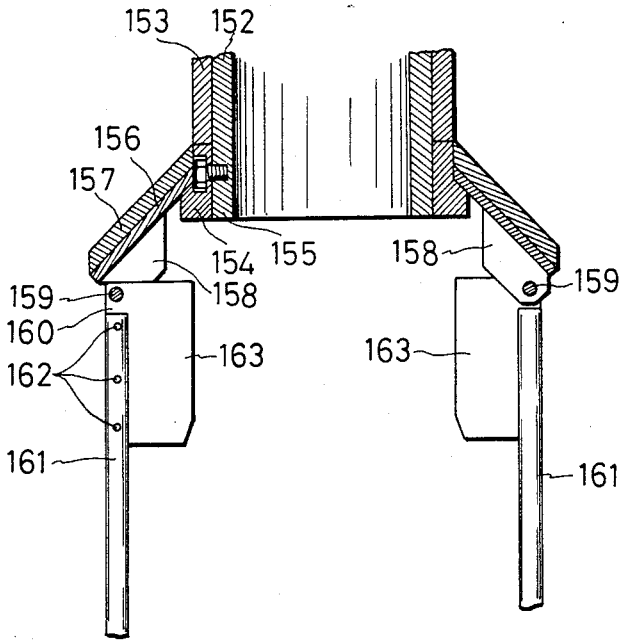
FIG. 25 is a longitudinal section illustrating the relationship between cushion pieces and the support members therefor.
Figure 26:
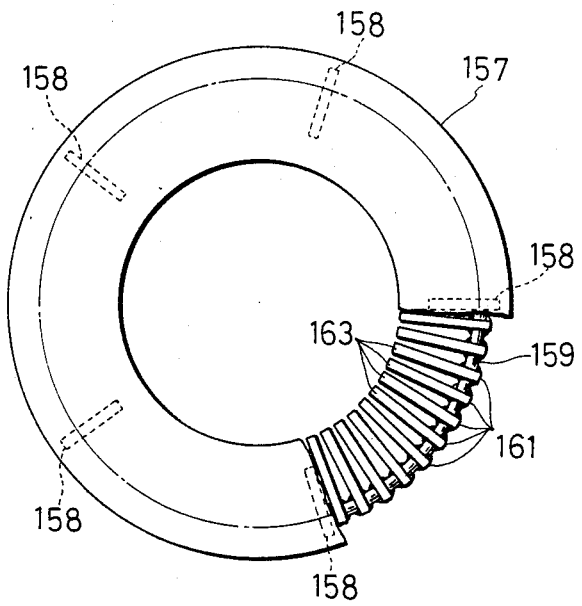
FIG. 26 is a plan view (in partial section) of the members shown in FIG. 25.
Figure 29:
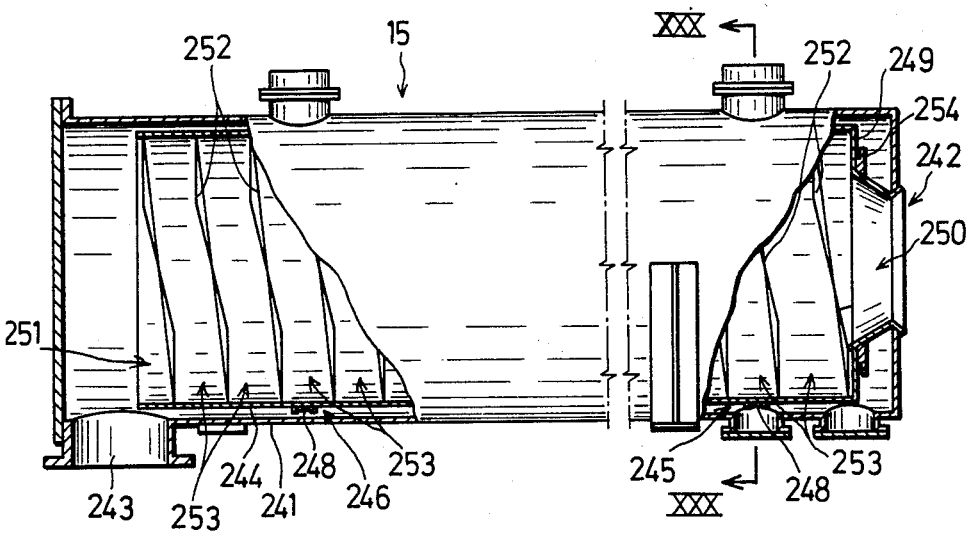
FIG. 29 is a front elevation in partial section of a drum feeder.
Figure 30:
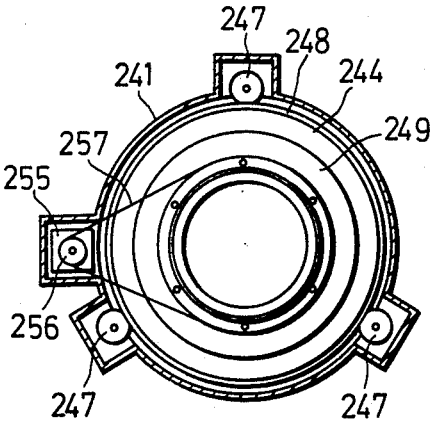
FIG. 30 is a view of a casing alone of the drum feeder, taken along the line XXX—XXX of FIG. 29.

A different example of the guide cylinder is not shown in FIGS. 24 to 28. The guide cylinder shown in these figures is therein provided with a cushion means to suppress the speed of the dropping raw material. In the figures, a cylinder member 152 is positioned along the center axis of the cylindrical portion 54*h* of the hermetic sealing portion 22*h* and the upper guide cylinder 59*h* of the guide cylinder 23*h*. The outer surface of this cylinder member 152, except for the upper portion thereof, is covered with a guard pipe 153 made of titanium. Even if some pieces, which are chipped off from the gurd pipe 153 by the raw material rushing thereon from the feed port 57*h*, drop accidently into the melting pot together with the raw material, the purity of the raw material in the melting pot, therefor, is never lowered. A hold ring 154 is secured to the lowermost end of the cylinder member 152 with fastenings 155. The upper edge of a funnel-shaped base member 156 is connected with the ring 154. This base member is made of stainless steel and the outer surface thereof is covered with a liner 157. This liner is used for the same purpose as that for said gurd pipe 153. The inner surface of said base portion 156 is provided with a plurality of support pieces 158, in which a ring shaft member 159 is supported. The ring shaft member is made in the form of a circular ring with the center thereof on the axis of the cylindrical member 152. Connection pieces 160 are suspended from the ring shaft member 159 for free swing motion. The top portion of a cushion piece 161 made of titanium is fixed on said connection piece 160 with a plurality of fastening pieces 162. The cushion pieces 161 is consequently in position to swing in the radial direction of the guide cylinder 23*h*, with a line parallel to the axis of said ring shaft member 159 as the neutral line, like a pendulum. Said connection piece is integrally formed with a weight 163, which exerts such a force on the cushion piece that tends to outwardly move the lower end of the cushion piece 161. In the situation as shown in FIG. 24, the lower end of the cushion piece 161 is thus in abutment with the lining 61*h* provided on the internal surface of the lower tapered guide cylinder 60*h*. To the lower end of said gurd pipe 153 are connected one ends of a plurality of horizontal spacing pieces 164, the other ends thereof being in contact with the internal surface of the upper guide cylinder 59*h*. In this manner, the cylinder member 152 is fixedly positioned coaxially with the guide cylinder 59*h*.

In the above mentioned construction, the small size raw material, brought to the feed port 57*h*, is guided by the lower tapered guide cylinder 60*h* to be concentrated towards the axis thereof and strikes the cushion piece 161. The raw material tilts inwards the cushion piece 161, then drops towards the lower opening 60*ah* of the tapered guide cylinder 60*h* through the annular gap formed between the cushion piece 161 and the lining 61*h*, and drops therefrom into the molten pool of metal in the melting pot as in the aforementioned case. Even if the small size raw material forcibly enters the guide cylinder 23*h* from the feed port 57*h* in this case, the kinetic energy thereof, therefor, is absorbed by the cushion piece 161, and is gently charged into the molten pool of metal in the melting pot. As a consequence of this, the raw material never falls on the edge of or outside the melting pot but drops correctly on the central area of the melting pot. Said cushioning operation is effective for slowing down not only the small size raw material but also the large size one. When a raw material, which is too light to tilt said cushion piece 161, falls outside the same, the material is temporarily stopped on the cushion member 161. When the weight of the stopped and piled raw material amounts to a value sufficient to tilt the cushion piece 161, the raw material moves the cushion piece 161 inwardly, dropping into the melting pot.

As shown by the conceptional line in FIG. 24, a limiter 68*h*, similar to the aforementioned one, may be accommodated inside the guide cylinder 23*h*. With the construction provided with such a limiter 68*h*, the following functional feature is obtained. Namely, the small size raw material is slowed down and is dropped towards the melting pot as in the previous case. On the other hand, since the cushion piece 161 is in abutment with the limiter 68*h* as shown by the conceptional line in FIG. 24, the large size raw material 151*h* is stopped between the cushion piece 161 and the internal surface of the lower tapered guide cylinder 60*h*. By lifting up the limiter 68*h*, the raw material 151*h* is made to further tilt the cushion piece 161 and passes under the limiter 68*h*, dropping from the lower opening 60*ah* towards the melting pot. In this example also, the raw material of a size larger than the prescribed one can temporarily be stopped as mentioned above, by suitably positioning the limiter 68*h* at a corresponding height beforehand. In explaining the example shown in FIGS. 24 to 28, the members, which are considered to be the same as or constructionally equivalent to those shown in previous figures, are given numerals the same as in previous figures but with an alphabetical suffix h and the same description is not repeated.

The drum feeder 15 in said raw material feeding apparatus A is now described in detail with reference to FIGS. 29 to 36. A hollow casing 241 is hermetically formed so as to isolate the space therein from the outer atmosphere and one end thereof is formed with a charge entrance 242 and the other end with a connection port 243 for the aforementioned shoot 17. Inside the casing 241 is rotatably accommodated a cylindrical drum 244, which is supported by a set of three support rollers 247 at two locations shown by numerals 245 and 246. The cylindrical drum 244 is peripherally provided with abutting bands 248, against which the support rollers 247 abut. In said casing 241, one end of said cylindrical drum 244 close to said charge entrance 242 is defined by an annular plate 249 and the opening thereof is alloted to a raw material receive port 250. The other end of the cylindrical drum is open and is alloted to a raw material send forth port 251. The cylindrical drum is interiorly provided with a compartment wall 252 along a helix on the internal surface of the cylindrical drum and a helical raw material part 253 is formed between two adjacent parts of said compartment wall 252. The helix, for example, has 13 pitches. The number of the pitches, however, may be smaller if a batch of raw material, given from the receive port 250 per one feed operation, can be mixed sufficiently before it is sent out through the raw material path 253 to the send forth port 251. The height of the compartment wall 252 is preferably such a value that the batch of raw material contained in one of the pitches of the raw material path 253 cannot get over the compartment wall to another adjacent batch of raw material, and should be determined in accordance with the weight of the batch of raw material, the diameter of the cylindrical drum 244 and so on. If the diameter of the cylindrical drum 244 is about 1100 mm, the weight of the batch of raw material is about 20 kg, and the axial length of one pitch is 225 mm, the height of the compartment wall 252 is preferably about 300 mm. With these parameters, scrap pieces of maximum 80 mm cube can be smoothly transferred. The cylindrical drum 244, in the case of the present example, is mounted substantially horizontally but may be tilted within an angle of 5° with the side of the send forth port 251 slightly raised.

When charging the raw material into the drum feeder 15 constructed as mentioned above, the bucket conveyer 11 is first shifted by the length of one bucket, and one batch of raw material is all charged into the pitch of the raw material path nearest to the receive port 250. The cylindrical drum is next rotated in a 360° arc and the batch of raw material is shifted along the path 253 by one pitch thereof towards the send forth port 251. In this situation, the bucket conveyer 11 is again shifted by one pitch stroke similarly as just mentioned above, and the next batch of raw material is charged. The rest of the batches of raw material are sequentially charged into respective pitches of the path 253 by repeatedly shifting the bucket conveyer 11 by one pitch stroke.

When the raw material is sent out towards the aforementioned melting chamber 20, the charge entrance 242 is now hermetically shut and the atmosphere of the casing 241 is replaced with a nonoxidizing gas, for example, argon gas. The cylindrical drum 244 is then continuously rotated and the raw material is sent out from the send out port 251 towards the connection port 243. While the raw material fed by the first of the two drum feeders 15 is molten, the other drum feeder is filled with raw material by operating the weighing cut down apparatus. When all the raw material in the first drum feeder is discharged out and the other one is completely filled up with the raw material, the two drum feeders are interchanged, and the whole prescribed quantity of the raw material to be melted is continuously fed by repeating the above operations.

Figure 36:
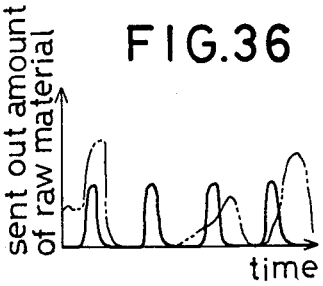
FIG. 36 is a graph exhibiting the relationship between temporal lapse and the feed rate of raw material.
Figure 31:
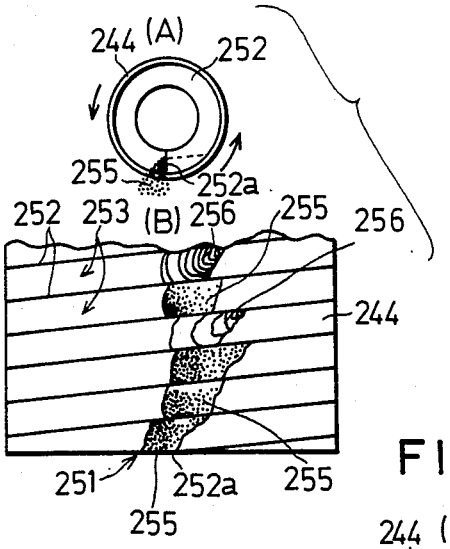
FIGS. 31 to 35 are views for explaining related operations.
Figure 34:
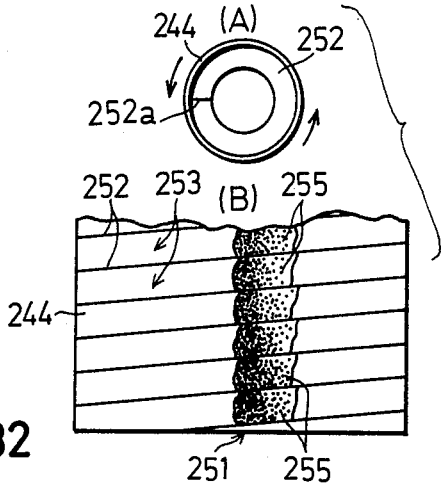
Figure 32:
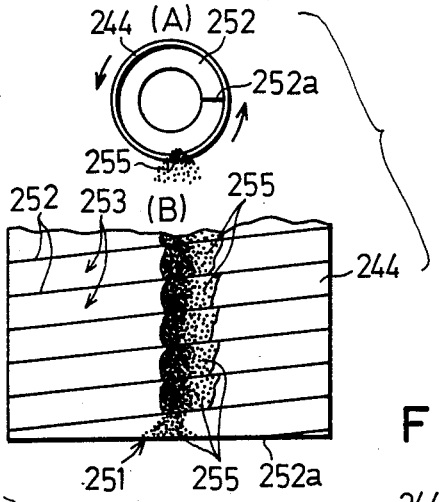
Figure 33:
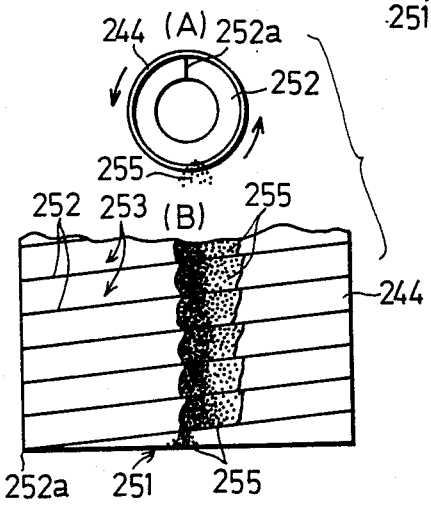
Figure 35:
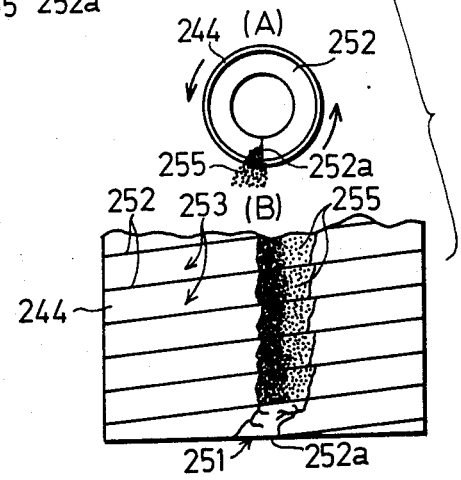
Figure 37:
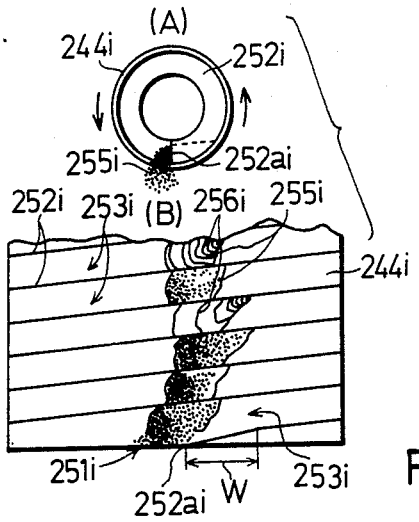
FIGS. 37 to 41 are views for explaining the operation of a different example (corresponding to FIGS. 31 to 35)
Figure 40:
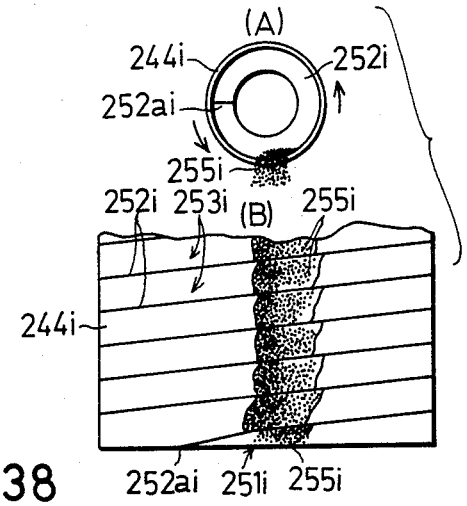
Figure 38:
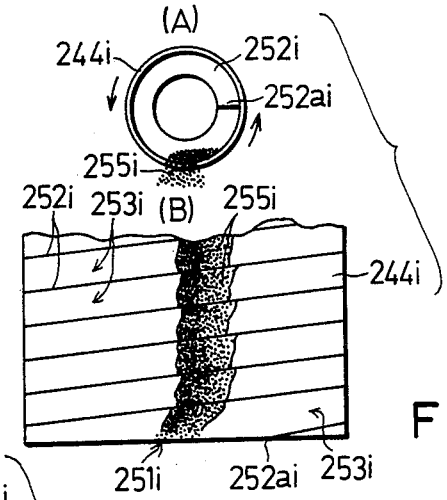
Figure 39:
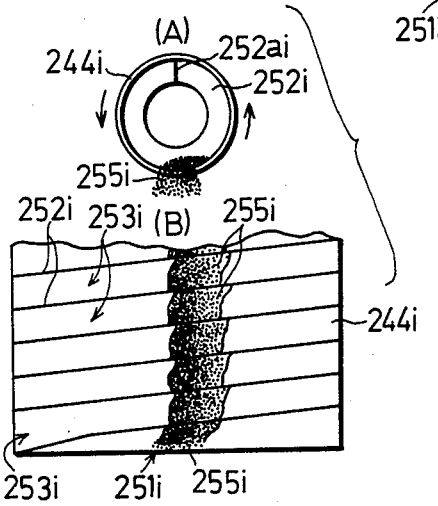
Figure 41:
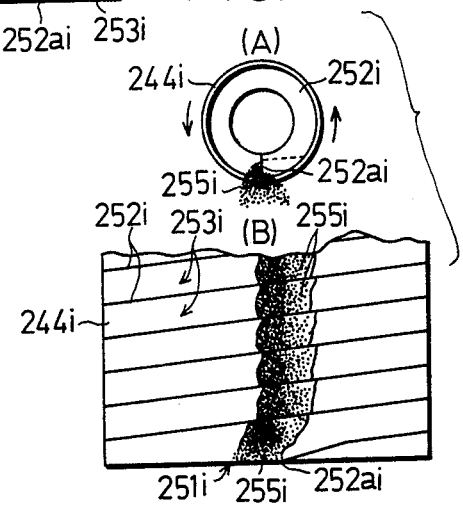

The process in which the raw material is sent out by rotating the cylindrical drum 244 is now described with reference to FIGS. 31 to 35. In these figures, (A) shows the cylindrical drum as viewed from the side of the send forth port 251 and (B) is a view taken by developing the cylindrical drum 244 along the uppermost longitudinal line thereof in the respective situation. Each batch 255 of raw material contained in the path 253 is brought upwards and made to repeatedly crumble by the internal surface of the cylindrical drum 244 rotating in the direction as shown by arrows. As a result of this repeated operation, each batch 255 of raw material is successively transferred towards the send forth port 251 along the helical raw material path 253. Each batch can be sufficiently mixed while it is transferred. A numeral 256 in FIG. 31 (B) shows a contour line of the batch of raw material put in one pitch of the raw material path 253. The batch 255 of raw material, having been transferred to the send forth port 251 by said rotating cylindrical drum 244, begins to fall from the send forth port 251 just at the time or thereafter when the rear edge 252*a* of the compartment wall 252 comes to the lowermost position thereof as shown in FIG. 31. Most of the raw material in a batch has fallen out during the time interval in which the cylindrical drum 244 is making a revolution in a 90° arc from the position as shown in FIG. 31 to that as shown in FIG. 32. By the time the cylindrical drum 244 has made a revolution in a 180° arc from the position as shown in FIG. 31 to that as shown in FIG. 33, almost all the raw material in a batch falls from the send forth port 251. The situation as shown in FIG. 35 results thereafter via that as shown in FIG. 34. Namely, the same situation as shown in FIG. 31 appears again and the next batch of raw material is now in position to be sent out. These operations are repeatedly performed and successive batches of raw material can be sequentially sent out from the send forth port 51 towards the melting chamber, without being mutually mixed. The temporal profile of the sent out amount of raw material is shown in FIG. 36 by a solid curve. Namely, a constant amount of raw material is sent out in a constant time interval in the lapse of time. The rate of supplied raw material in the melting chamber does not vary consequently even at the earlier or the later stage of a melting process and the raw material scarcely becomes excessive or insufficient. The ingots produced by said casting apparatus A are thus free from inhomogeneous roughness and fineness of constitution.

In the case of the above-mentioned example, the batch of raw material can more slowly be sent out in a rather long time interval during a full revolution of the cylindrical drum 244, by tilting the same so as to slightly raise the send forth port 251 thereof. The variation of the rate of raw material supplied into the melting chamber can further be decreased and the roughness and fineness of said ingots is decreased.

Figure 48:
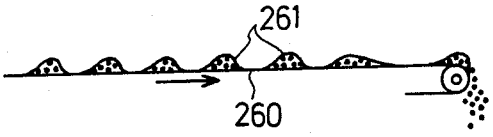
FIG. 48 is a schematic view of the raw material of the conventional transfer means.

With use of the drum feeder 15 constructed as described above, the following drawbacks in the prior art can effectively be eliminated. In a conventional melting cast installation for metals, the raw material, cut down from a hopper, is weighed to be subdivided into a number of samll items, which, shown by a numeral 261, are successively placed on a belt conveyer 260 as shown in FIG. 48 and are continuously carried to a melting pot by driving the belt conveyer 260 in the direction shown by the arrow. It is a drawback that the items of raw material cut down earlier and those cut down later by the hopper are apt to be of different grain size, different proportion of alloy constituents and so on. It is also a drawback that items 261 are relatively displaced, owing to the vibration and the like in the course of the transfer by the belt conveyer, the pile of an item swelling accidentally and that of another item dimishing in size. When such uneven items of raw material are successively sent into the melting chamber, it is very objectionable that the content of the item supplied earlier differs from that of the item supplied later or that the rate of the raw material sent into the melting chamber varies temporally at random as shown by a double dot chain line in FIG. 36. When the property of the items varies greatly, the raw material is irregularly melted in the melting chamber and there appears nonuniform roughness and smallness in the ingots obtained by solidifying the molten raw material. When alloy ingots are to be produced, the mutual mixing of items of raw material on the belt conveyer makes the composition proportion of raw material vary irregularly from place to place and the objectionable segregation will subsequently take place in the ingots obtained by solidifying such irregular molten raw material. As opposed to these drawbacks, in the above mentioned new construction, the weighing cut down means subdivides raw material into batches 255, which are directly sent to the cylindrical drum 244 and are directed towards the melting chamber 20 through the raw material path formed helically on the internal surface of the cylindrical drum 244. Th present construction exhibits thus the following effects.

As the first point, the batches of raw material, which have been weighed and brought into the raw material path, are advanced in line in the axial direction of the cylindrical drum, without being mixed with other proximate batches. This prevents the raw material property (the mixture ratio of plural elementary materials) of each batch from being changed as a consequence of partially mixing with another batch, and lets each batch directly reach the melting chamber, a superior molten pool of metal being there produced.

As the second point, the batch disposed in each pitch of the raw material path 253 is also moved, on the internal (concave) surface of the cylindrical drum, transversely to the axis thereof, and the mixing effect on each batch of material is subsequently remarkable, producing good effects in homogenizing the molten pool of metal in the next step.

Figure 42:
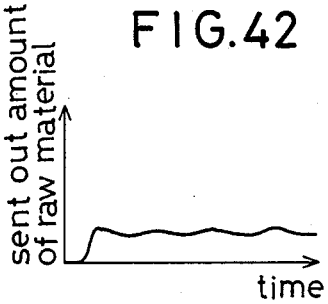
FIG. 42 is a graph showing the relationship between temporal lapse and the feed rate of raw material for the embodiment shown in FIGS. 37 to 41.

In reference to FIGS. 37 to 41, a different embodiment is now shown in which the compartment wall is differently mounted. In the embodiment shown here, the pitch of the helix of the compartment wall **252*i* is a little elongated near the send forth port 251*i* so that the width of the raw material path 253*i* is there increasing towards the send forth port 251*i*. Owing to the increasing width of the raw material path 253*i*, the batch 255*i* of raw material near the send forth port is prevented from rapidly crumbling, on revolution of the cylindrical drum 244, and it can be continuously sent out little by little in the whole process of the complete revolution of the cylindrical drum 244*i* as shown in FIGS. 37 to 41, the same operation being successively possible with a lot of batches of raw material. Namely, as shown in FIG. 42, the raw material can be supplied to the melting chamber at a constant rate in the lapse of time. As a consequence of this, the raw material is always fed at a constant rate in the melting chamber, and ingots of completely uniform density are produced in the casting apparatus. That is, ingots free from segregation are obtained. The circumferential interval W, where the pitch of the helix of the compartment wall 252*j* is increasing, is chosen to be, for example, about one fourth of the whole circumference of the cylindrical drum 244*i* and the increased pitch in said interval is set equal to about twice the normal pitch. The extent, to which the interval W or the pitch of the helix is therein increased, is preferably determined on the basis of experiment in accordance with the weight of the batch of raw material, the height and the pitch of the compartment wall 252*i*, the speed of revolution of the cylindrical drum 244*i* and so on. It should namely be determined so that the batch of raw material may be continuously sent out from the send forth port 251*i* bit by bit in the course of the whole revolution of the cylindrical drum 244*i***.

The members, which are considered to be the same or constructionally equivalent to those shown in FIGS. 29 to 36, are given the numerals same as in the previous figures but with an alphabetical suffix i, and the same description is not repeated. (As for the next and following drawings also, alphabetical suffixes j, k and m are used in this order according to the same idea and the same description is omitted.)

Figure 43:
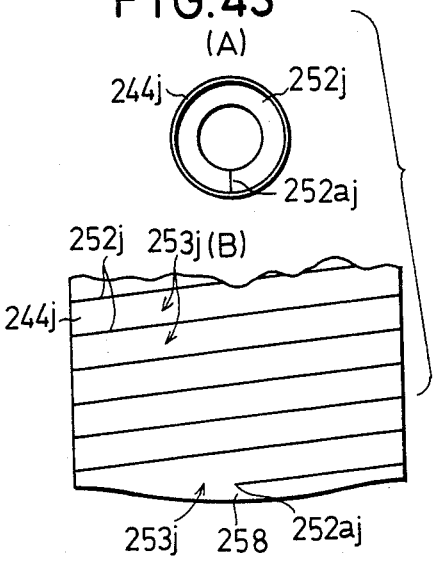
FIG. 43 is a view illustrating a yet different example of the cylindrical drum.
Figure 44:
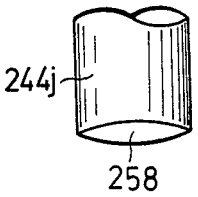
FIGS. 44 and 45 are a plan view and a right side elevation of the example shown in FIG. 43, respectively.
Figure 45:
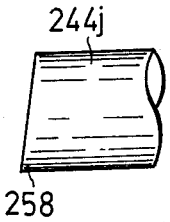

In FIGS. 43 to 45, is illustrated an embodiment in which the form of the cylindrical drum near the send forth port is made different from that as mentioned above so that the raw material path is broader near the send forth port. The cylindrical drum **244*j* is a little elongated at the end portion 252*aj* of the compartment wall 252*j* so as to have an overhang 258 extending therefrom. As a consequence of this construction, the raw material can continuously be sent out little by little in the course of the full revolution of the cylindrical drum 244***j* in the same manner as in the previous embodiments. The size of extension of the overhang 258 is approximately half the pitch of the helix of the compartment wall 252*j* but is preferably determined on the base of experiment as in the previous embodiment.

Figure 46:
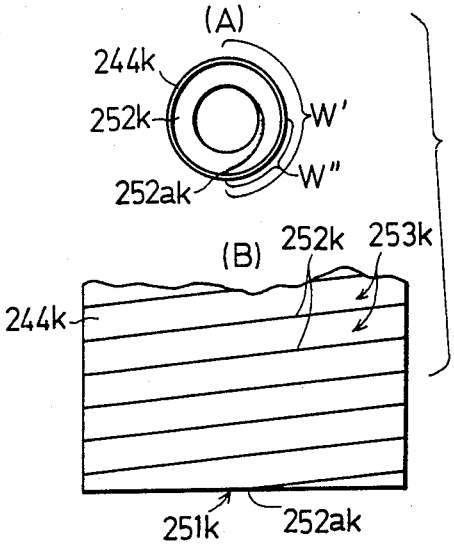
FIGS. 46 and 47 are views illustrating a still different example of the cylindrical drum.

In FIG. 46 is illustrated an embodiment in which the height of the compartment wall 252*k* is decreasing towards the send forth port 251*k*. As a consequence of this construction, the raw material can continuously be sent out litlle by little as in the previous cases. The height of the end portion 252*ak* is set equal to, for example, about one fourth of the normal height of the wall 252*k* and the circumferencial interval W', in which the height of the compartment wall 252*k* is decreasing, is determined to be equal, for example, to from 180° to 270°. The interval W', however, is preferably determined on the base of experiment as in the previous cases and it should be adjusted so that the batch of raw material may get over the compartment wall 252*k*, for example, in an interval of a 90° arc as shown by W" in FIG. 46(A).

Figure 47:
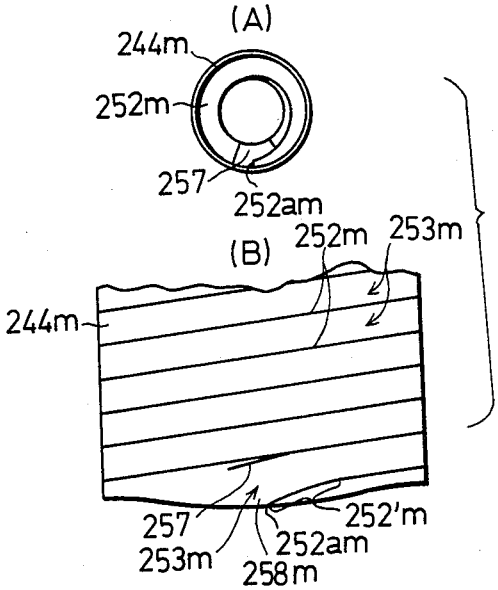

In FIG. 47 is illustrated an example concerning a different construction of the send forth port. In this example, a baffle plate 257 is provided on that part of the compartment wall which is one pitch up the end portion 252*am*. The pitch angle (made against the radial direction of the cylindrical drum) of the baffle plate is adjusted to be intermediate between the increased pitch angle at the portion 252'*k* of the compartment wall 252*k* and the normal one at the other portion.

As a consequence of this construction, the pile of the batch of raw material can be prevented from collapsing to be too widely scattered and thereby the peak rate of sent out raw material can further be lowered.

It also has an effect on obstructing the abrupt collapse of the batch of raw material 255*m* around the send forth port 251*m* to tilt the cylindrical drum 244*m* by an angle of about 5° with the side thereof close to the send forth port 251*m* slightly raised. In any of the embodiments as shown in FIGS. 37 to 47, the peak rate of the sent out raw material can all the more be decreased by tilting the cylindrical drum 244*m*.

As many apparently widely different embodiments of the present invention may be made without departing from the spirit and scope thereof, it is to be understood that the invention is not limited to the specific embodiments thereof except as defined in the appended claims.

What is claimed is:

1. A melting cast installation comprising: a melting apparatus for melting a metallic raw material into a molten pool of metal, a raw material feeding apparatus for feeding the raw material to said melting apparatus, and a casting apparatus for casting the molten pool of metal produced by said melting apparatus; said melting apparatus including a furnace wall formed with a lower opening for connection with a melting pot and with an upper annular rotatable portion thereof for revolution around the center axis of said lower opening, a guide cylinder having a vertical axis vertically positioned against said furnace wall, with the top end thereof passing through and disposed over said furnace wall and the lower end thereof positioned directly over said lower opening inside said furnace wall and a plurality of plasma arc torches radially arranged at regular intervals around the axis of said guide cylinder, pairs of said torches disposed opposite each other relative to said axis and individually directed toward said lower opening; a cylindrical limiter mounted vertically in said guide cylinder for vertical reciprocation against the lower opening of said guide cylinder; said casting apparatus including said melting post communicating and connecting with said lower-opening of said melting apparatus, with the bottom surface thereof having vertical movement, and withdrawing means to gradually lower said melting pot; said raw material feeding apparatus including a raw material send forth port connected with the top end of said guide cylinder.

2. A melting cast installation as described in claim 1, said raw material feeding apparatus further including a rotatable cylindrical drum laid substantially horizontally with one end thereof forming a raw material receive port and with the other end thereof forming said raw material send forth port, and a helical compartment wall positioned on the internal surface of said cylindrical drum, said compartment wall defining a helical raw material path running from said receive port to said send forth port.

3. A melting cast installation as described in claim 2, wherein said cylindrical drum is tilted with said receive port lowered and with said send forth port raised.

4. A melting cast installation as described in claim 2, wherein the pitch of said helical compartment wall is increased near said send forth port so that the distance between said compartment wall is increasing towards said send forth port.

5. A melting cast installation as described in claim 2, wherein the height of said compartment wall is decreased near said send forth port.

6. A melting cast installation as described in claim 1, wherein said melting apparatus includes an ignition piece inside said furnace wall, selectively adapted to take an advanced igniting position between the front ends of said plural plasma torches and said lower opening of said furnace wall or a withdrawn position retreated from said advanced position, and reciprocation means to selectively move said ignition piece to either of said two positions.

7. A melting cast installation as described in claim 1, wherein the lower end portion of said guide cylinder is funnel-shaped to be contracted towards the bottom end of said guide cylinder, and said melting apparatus includes a limiter, which is accomodated for vertical motion inside said lower portion of said cylindrical guide and is of such thickness that an annular space for passing the raw material can be formed between said limiter and the internal surface of the lower portion of said guide cylinder, and means to raise and lower said limiter.

8. A melting cast installation as described in claim 1, further including a plurality of cushion pieces vertically hung in said guide cylinder for free swing movement against and away from the internal surface of said guide cylinder, the lower ends of said cushion pieces being normally in contact with or close to said internal surface and being adapted to be deflected away from said internal surface by said dropping raw material so as to form a variable annular path for raw material, said dropping raw material being decelerated to be gently supplied toward said molten pool of metal.

9. A melting cast installation as described in claim 8, further including a cylindrical limiter vertically mounted inside said plural cushion pieces for vertical displacement to adjustably limit the deflection of said cushion pieces away from said internal surface.

10. A raw material feeding method with use of a melting cast installation comprising: providing a melting apparatus for melting a charged raw material into a molten pool of metal, providing a raw material feeding apparatus provided over said melting apparatus, and providing a casting apparatus for casting said molten pool of metal, said melting apparatus including a plurality of plasma arc torches arranged radially over said molten pool of metal, and said raw material feeding apparatus including a guide cylinder extending downwards inside said furnace wall and provided with a contracted lower portion thereof, and a cylindrical limiter mounted vertically in said guide cylinder for vertical reciprocation against the lower opening of said guide cylinder; and characterized by guiding said charged raw material by said guide cylinder towards said molten pool of metal, providing an adjustable annular space for passing said raw material between said limiter and the internal surface of said guide cylinder by displacing vertically said limiter, charging large size and small size raw materials into said raw material feeding apparatus, and dropping said small size raw material earlier and said large size raw material later toward said molten pool of metal by adjusting adequately the height of said limiter.

* * * * *